US007204573B2

(12) United States Patent
Koyama

(10) Patent No.: US 7,204,573 B2
(45) Date of Patent: Apr. 17, 2007

(54) VOLUME MEASURING METHOD, VOLUME MEASURING DEVICE AND DROPLET DISCHARGING DEVICE COMPRISING THE SAME, AND MANUFACTURING METHOD OF ELECTRO-OPTIC DEVICE, ELECTRO-OPTIC DEVICE AND ELECTRONIC EQUIPMENT

(75) Inventor: Minoru Koyama, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 371 days.

(21) Appl. No.: 10/961,249

(22) Filed: Oct. 12, 2004

(65) Prior Publication Data

US 2005/0122363 A1 Jun. 9, 2005

(30) Foreign Application Priority Data

Oct. 15, 2003 (JP) ..... 2003-354597

(51) Int. Cl.
*B41J 29/393* (2006.01)

(52) U.S. Cl. ..... 347/19

(58) Field of Classification Search ..... 347/19
See application file for complete search history.

(56) References Cited

U.S. PATENT DOCUMENTS 7,121,642 B2 * 10/2006 Stoessel et al. ..... 347/19
2004/0017443 A1 * 1/2004 Ikeda et al. ..... 347/84

FOREIGN PATENT DOCUMENTS

JP A 5-149769 6/1993
JP A-5-180683 7/1993

* cited by examiner

*Primary Examiner*—Stephen Meier
*Assistant Examiner*—Jason S Uhlenhake
(74) *Attorney, Agent, or Firm*—Oliff & Berridge, PLC

(57) ABSTRACT

Exemplary embodiments of the present invention provide a volume measuring method and a volume measuring device which enable a volume of a minute droplet to be measured easily and precisely, and a droplet discharging device including this, and a manufacturing method of an electro-optic device, and the electro-optic device and electronic equipment. A volume measuring method of exemplary embodiments of the present invention include acquiring a central point in horizontal plane view of a droplet dropped on a horizontal plane as origin coordinates by image recognizing device, measuring outline coordinates of a droplet surface with respect to the origin coordinates at plurality of positions while scanning a line segment connecting the acquired central point in horizontal plane view and one arbitrary point A of an outer periphery of the droplet in a radial direction of the droplet by electromagnetic device, and calculating a volume of the droplet based on the measurement result of the outline coordinates.

17 Claims, 23 Drawing Sheets

| NO. | DISTANCE FROM CENTRAL POINT [μm] | HEIGHT [μm] |
|---|---|---|
| 1 | 0 | 8.5 |
| 2 | 1 | 8.4 |
| 3 | 2 | 8.3 |
| ⋮ | ⋮ | ⋮ |
| n − 2 | n − 3 | 1.3 |
| n − 1 | n − 2 | 0.9 |
| n | n − 1 | 0.5 |
| n + 1 | n | 0 |
| n + 2 | n + 1 | 0 |

FIG. 5

VOLUME MEASURING METHOD, VOLUME MEASURING DEVICE AND DROPLET DISCHARGING DEVICE COMPRISING THE SAME, AND MANUFACTURING METHOD OF ELECTRO-OPTIC DEVICE, ELECTRO-OPTIC DEVICE AND ELECTRONIC EQUIPMENT

BACKGROUND OF THE INVENTION

1. Field of Invention

Exemplary embodiment of the present invention relate to a volume measuring method to measure a volume of a droplet dropped on a horizontal plane, a volume measuring device, a droplet discharging device including the same. Exemplary embodiments further relate to a manufacturing method of an electro-optic device, the electro-optic device and electronic equipment.

2. Description of Related Art

In the related art, in order to precisely detect a volume of a droplet discharged from a droplet discharging head, a volume of a flying droplet is calculated based on a flight image imaged from a direction perpendicular to a flight direction thereof.

This volume calculating method has a structure that supposing that the droplet during flight has a rotation-symmetrical shape with respect to a flight axis, integration with respect to the central axis is performed for the flight image to measure the volume. Such a related art method is disclosed in Japanese Unexamined Patent Publication No. H5-149769.

SUMMARY OF THE INVENTION

The related art includes a problem with the flight direction of the droplet discharged from the droplet discharging head. Specifically, a shape of the droplet during flight is erratic, depending on a state of a nozzle opening (a meniscus state or a state of water repellent treatment), which complicates the volume calculation. Furthermore, there is another problem that since an image of the droplet during flight is imaged, the outline of the droplet in the flight image is not clear, and the image size of the droplet is not precise, so that the volume cannot be measured precisely.

Exemplary embodiments of the present invention provide a volume measuring method enabling a volume of a minute droplet to be measured easily and precisely, a volume measuring device, and a droplet discharging device including the same. Exemplary embodiments further provide a manufacturing method of an electro-optic device, the electro-optic device, and electronic equipment.

A volume measuring method of exemplary embodiments of the present invention includes acquiring a central point in a horizontal plane view of a droplet dropped on a horizontal plane as origin coordinates by an image recognizing device; measuring outline coordinates of a droplet surface with respect to the origin coordinates, at a plurality of positions while scanning a line segment connecting the acquired central point in horizontal plane view and one arbitrary point of an outer periphery of the droplet in a radial direction of the droplet by an electromagnetic measuring device; and calculating a volume of the droplet based on the measurement result of the outline coordinates.

The droplet dropped on the horizontal plane can have a substantially semispherical shape rotation-symmetrical with respect to a central axis. In the measurement of the volume of the droplet having such a shape, the shape of the droplet can be considered to be structured by piling up a plurality of cylinders having the same central axis, and by taking a sum of the volumes of these cylinders, the volume of the droplet can be calculated. In this manner, by segmentalizing the droplet in a height direction of the droplet, the volume of the droplet can be calculated precisely.

According to the above-mentioned structure, in the origin coordinate acquiring, the image recognizing device acquires the central point in horizontal plane view as the origin coordinates. Then in the coordinate measuring, the electromagnetic device measures the outline coordinates of the droplet surface with respect to the origin coordinates (central point in horizontal plane view) which are a reference, at a plurality of positions. Thereby, a radius and a height necessary to measure the volume of each of the cylinders can be given, and only by acquiring the outline coordinates while scanning the part corresponding to the radius in horizontal plane view of the droplet, the volume of the droplet can be calculated. Accordingly, the scanning can be completed in a short period of time and thus time required for the volume calculation can be shortened.

In this case, it is preferable that in the origin coordinate acquiring a recognition image image-recognized by the image recognizing device is binarized into a droplet image and a peripheral image thereof, thereby determining an outline of the droplet to acquire the central point in horizontal plane view as the origin coordinates, and that in the case where the outline has a shape extremely misfitting a perfect circle, this is informed as an error.

According to this structure, since the binarization of the recognition image can make the outline of the droplet clear, in the origin coordinate acquiring, it can be recognized that the outline has a shape extremely deviating from a perfect circle. Therefore, this droplet having the shape deviating from the perfect circle can be excluded from the volume calculation object by error information and thus, a constant volume calculation precision can be guaranteed. Furthermore, by obtaining the origin coordinates which are a central point in horizontal plane view from the above-mentioned exact outline, an acquiring precision of the central point in horizontal plane view is improved and consequently, the volume can be precisely calculated. In regard to an allowable range in the judgment of the perfect circle, it is preferable that 5% of deformation amount is its maximum limit.

In this case, it is preferable that in the coordinate measuring, the scanning is performed from the central point in horizontal plane view toward the outer periphery and that when a value of a height of the outline coordinates becomes zero, the electromagnetic measuring device judges that the one arbitrary point of the outer periphery is reached.

According to this structure, since the scanning starts at the central point in horizontal plane view which is the origin coordinates acquired in the origin coordinate acquiring, wasteful scanning can be omitted, thereby shortening the volume calculation time. Furthermore, since it is judged that the outer periphery is reached from the actual measurement value, the one arbitrary point of the outer periphery does not need to be specified in advance.

In this case, it is preferable that in the coordinate measuring, the scanning of the electromagnetic measuring device is performed by intermittent movement corresponding to the measurement of the outline coordinates at the plurality of positions.

According to this structure, since the electromagnetic device measures the outline coordinates while being precisely positioned in a stopping state at measuring positions of each of the outline coordinates, the outline coordinates can be measured precisely.

In this case, it is preferable that an interval between the respective positions in the measurement of the outline coordinates at the plurality of positions is gradually reduced from the central point in horizontal plane view toward the outer periphery.

According to this structure, the coordinates in the vicinity of the outer periphery where change in the height of the outline coordinates of the droplet becomes large can be measured accurately, and thus the volume calculation precision can be enhanced and/or improved.

In this case, it is preferable that in the coordinate measuring, the measurement by the electromagnetic measuring device is repeated several times, whose scanning direction varies, and that in the volume calculating, the volume is calculated based on an average value of the plurality of outline coordinates obtained by repeating.

According to this structure, by taking the average value of the plurality of outline coordinates of the droplet surface obtained by the measurement repeated several times, even if the it is slightly deformed in horizontal plane view, the average outline coordinates can be measured. As a result, the volume calculation precision can be enhanced and/or improved. A structure may be employed in which the volume is calculated for each of the plurality of outline coordinates obtained with the scanning direction varied and an average of the volumes is calculated.

In this case, it is preferable that the electromagnetic measuring device is a laser type distance meter using laser light as measuring light.

According to this structure, the coordinate measurement of a minute region in the droplet surface is enabled by the simple device, and the measurement precision can be enhanced and/or improved.

A volume measuring device of exemplary embodiments of the present invention includes: an image recognizing device to image a droplet dropped on a horizontal plane and acquiring a central point in horizontal plane view of the droplet as origin coordinates; a coordinate measuring device to measure outline coordinates of a droplet surface with respect to the origin coordinates at a plurality of positions while scanning a line segment connecting the central point in horizontal plane view and one arbitrary point of an outer periphery of the droplet in a radial direction of the droplet; and a volume calculating device to calculate a volume of the droplet based on the measurement result of the outline coordinates.

According to this structure, since the radius and the height necessary for the volume measurement of each of the cylinders can be given from the outline coordinates of the droplet surface, only by scanning the part corresponding to the radius in horizontal plane view of the droplet, the volume of the droplet can be calculated. Thereby, the scanning can be completed in a short period of time and the volume can be calculated quickly.

In this case, it is preferable that the coordinate measuring device moves intermittently corresponding to the measurement of the outline coordinates at the plurality of positions, and that the measurement is performed when the movement is ceased.

According to this structure, since the outline coordinates are measured while being precisely positioned in a stopping state at measuring positions of each of the outline coordinates, the volume can be measured precisely.

In this case, it is preferable that the coordinate measuring device repeats the measurement several times whose scanning direction varies, and that the volume calculating device calculates the volume based on an average value of the plurality of outline coordinates obtained by repeating.

According to this structure, a measurement defect due to the fluctuation in the outline coordinates in each radius in horizontal plane view of the droplet can be reduced or prevented, thereby enhancing or improving the volume calculation precision. A structure may be employed in which the volume is calculated for each of the plurality of outline coordinates obtained with the scanning direction varied and an average of the volumes is calculated.

In this case, it is preferable that the coordinate measuring device is a laser type distance meter using laser light as measuring light.

According to this structure, the coordinate measurement of a minute region in the droplet surface is enabled by the simple device, and the measurement precision can be enhanced and/or improved.

A droplet discharging device of exemplary embodiments of the present invention includes: a droplet discharging head discharging a functional droplet to a work from a plurality of nozzles to form a film formation part; an X/Y moving mechanism relatively moving the work with respect to the droplet discharging head in an X axial direction and a Y axial direction; the volume measuring device that calculates a volume of the functional droplet which is the droplet discharged from each of the nozzles; and a head control device correcting a drive wave so as to uniformize the respective nozzles from the volume of the functional droplet of each of the plurality of nozzles calculated by the volume measuring device.

According to this structure, since the volume of the functional droplet discharged by the droplet discharging head can be calculated by the volume measuring device, in regard to a minute amount of functional droplet which easily evaporates, a volume thereof can be calculated quickly. Furthermore, by performing correction based on the calculation result, the volume of the functional droplet discharged from each of the nozzles can be precisely controlled. In order to perform the correction so as to uniformize, the discharging liquid amounts (volumes) of all the nozzles, the volumes may be set to be within a range specified in advance, or a range may be determined based on the average value of all the nozzles.

In this case, it is preferable that the coordinate measuring device includes a measuring device to measure outline coordinates of a droplet surface with respect to the origin coordinates at a plurality of positions in regard to the line segment, and scanning device to make the measuring device scan the line segment in the radial direction of the functional droplet along with the measuring, the droplet discharging head being mounted on the X/Y moving mechanism via a carriage, the X/Y moving mechanism also functions as the scanning device, and the measuring device being attached to the carriage.

According to this structure, the droplet discharging head discharges the functional droplet on the horizontal plane, and simultaneously the X/Y moving mechanism which is the scanning device makes the carriage scan, so that the outline coordinates of the droplet can be measured by the measuring device mounted on the carriage. This allows the X/Y moving mechanism to be used as the scanning device, and thus, the measurement precision can be enhanced and/or improved, and the structure can be simplified.

In this case, it is preferable that the image recognizing device is attached to the carriage.

According to this structure, since the image recognition of the droplet can be performed after moving vertically above the droplet, a precise outline can be determined, and the central point in horizontal plane view can be acquired precisely. Furthermore, the discharge of the droplet and the image recognition can be performed continuously.

In a manufacturing method of an electro-optic device of exemplary embodiments of the present invention, using the above-mentioned droplet discharging device, the film formation part made of the functional droplet is formed in the work.

In an electro-optic device of exemplary embodiments of the present invention, using the above-mentioned droplet discharging device, the film formation part made of the function droplet is formed in the work.

According to these structures, since it is manufactured using the droplet discharging device capable of precisely discharging an exact liquid amount of functional droplet from the nozzle, the highly reliable electro-optic device can be manufactured. As the electro-optic device (flat panel display), a color filter, a liquid crystal display device, an organic EL device, a PDP device, an electron emission device or the like can be considered. The electron emission device denotes a concept including a so-called FED (Field Emission Display) and SED (Surface-conduction Electron-Emitter Display) devices. Furthermore, as the electro-optic device, devices including metal wiring formation, lens formation, resist formation and light diffusive element formation or the like can be considered.

Electronic equipment of exemplary embodiments of the present invention mounts the electro-optic device manufactured by the above-mentioned manufacturing method of the electro-optic device or the above-mentioned electro-optic device.

In this case, as the electronic equipment, a cellular phone, a personal computer, and various electrical products each mounting the so-called flat panel display are relevant.

As described above, according to the volume measuring method and the volume measuring device of exemplary embodiments of the present invention, the volume of the droplet can be accurately measured in a short period of time. Furthermore, using this volume measuring device, the volume of the functional droplet discharged from the droplet discharging head, which is a minute droplet, is calculated, and based on the result, the drive wave of the nozzle is corrected, thereby precisely controlling the volume of the functional droplet discharged from each of the nozzles.

Furthermore, since the manufacturing method of the electro-optic device, the electro-optic device, and the electronic equipment of exemplary embodiments of the present invention are manufactured by using the droplet discharging device including the above-mentioned volume measuring device, reliability of the work can be enhanced or improved, and the efficient manufacturing of these is enabled.

BRIEF DESCRIPTION OF THE DRAWINGS

FIG. 5 is an explanatory table showing distances from the central point of the droplet and averages of height;

DETAILED DESCRIPTION OF PREFERRED EMBODIMENTS

Hereinafter, referring to the attached drawings, a description of a droplet discharging device to which a volume measuring method and a volume measuring device of exemplary embodiments of the present invention are applied, is given. The droplet discharging device of the present exemplary embodiment is incorporated into a manufacturing line of an organic EL device or a liquid crystal display device which is one type of so-called flat panel displays. In the present exemplary embodiment, the droplet discharging device incorporated into the manufacturing line of the organic EL device is first described.

The droplet discharging device discharges a functional droplet (light emitting material) on a work (substrate) W by a droplet discharging head mounted thereon to form an EL light emitting layer and a hole injection layer of the organic EL device. A series of manufacturing steps including a discharging operation of this droplet discharging head are carried out inside of a chamber device maintaining dry air atmosphere so as to reduce or eliminate any effect of outside air.

Figure 1:
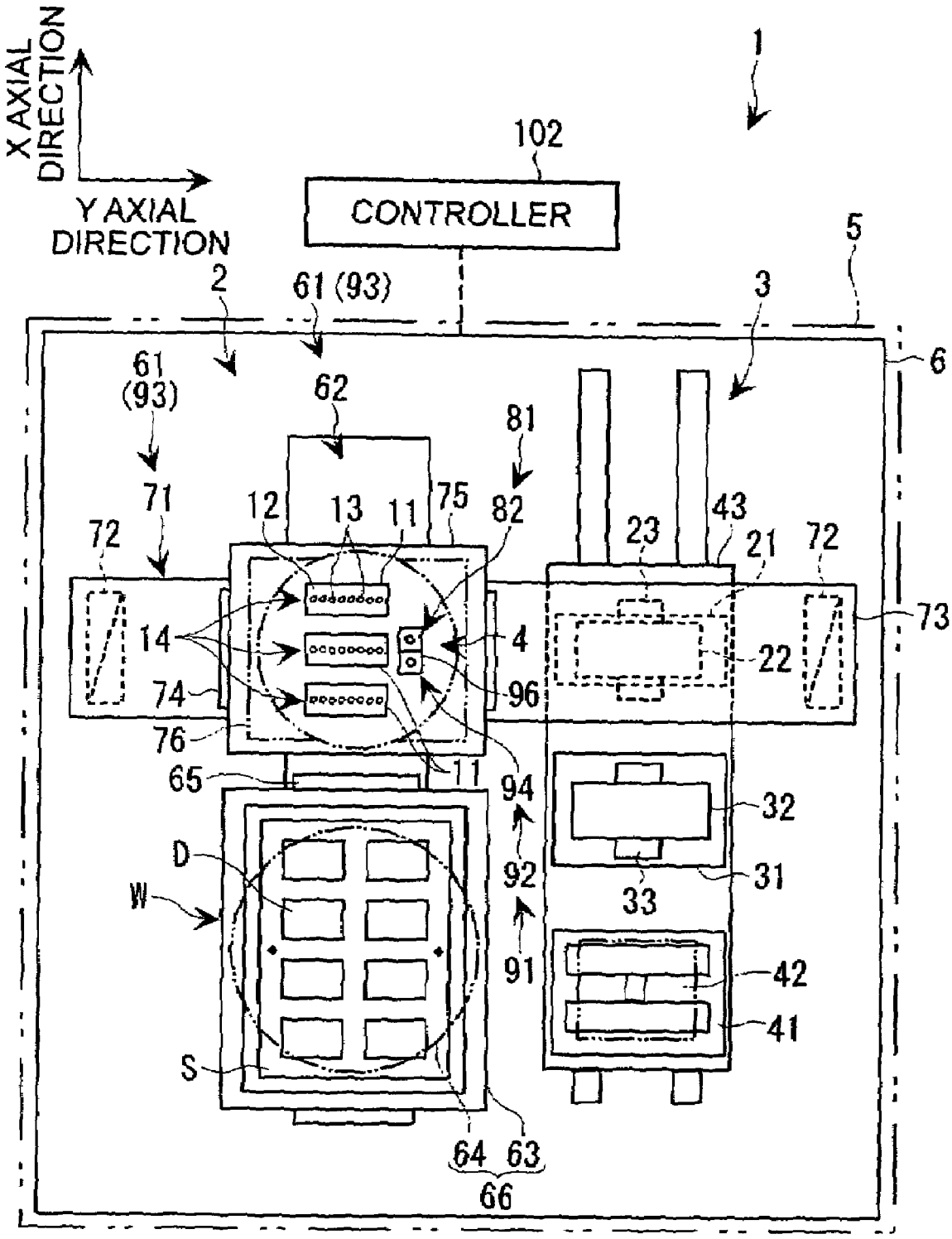
FIG. 1 is a plane schematic showing a droplet discharging device mounting a volume measuring device of an exemplary embodiment.

As shown in FIG. 1, a droplet discharging device 1 includes a machine table 6, a drawing device 2 arranged in the center above the machine table 6 in a crisscross shape and having three droplet discharging heads 11, a maintenance device 3 arranged in parallel with the drawing device 2 on the machine table 6 and composed of various devices for use in the maintenance of the droplet discharging heads 11 or the like. The above-mentioned chamber device 5 maintains these devices in dry air atmosphere as described above.

The drawing device 2 performs drawing by the functional droplet on the work W using the droplet discharging heads 11. The maintenance device 3 performs the maintenance of the droplet discharging heads 11 and checking as to whether or not the functional droplet is properly discharged from the droplet discharging heads 11, to stabilize the discharge of the functional droplet by the droplet discharging heads 11. Furthermore, the droplet discharging device 1 includes a functional liquid feeding device (omitted in the figure) to supply the functional liquid to the drawing device 2, a vacuum pump (omitted in the figure) to adsorb the work W which is continued to an adsorption table 63 described later, or the like.

The functional liquid feeding device has functional liquid tanks for three colors of R, G and B (omitted in the figure) to supply functional liquids of the three colors of R, G and B, respectively to the three droplet discharging heads 11. Furthermore, the droplet discharging device 1 includes a controller 102 controlling the above-mentioned respective component devices totally.

The maintenance device 3 has a storage unit 21 which is in close contact with the droplet discharging heads 11 during non-operation time of the droplet discharging device 1 to reduce or prevent them from being dried, a sucking unit 31 performing sucking (cleaning) to remove the functional liquid with an increased viscosity and receiving waste discharge (flashing) of the droplet discharging heads 11, and a wiping unit 41 to wipe off dirt attached on nozzle surfaces 12 of the droplet discharging heads 11. These respective units are mounted on a moving table 43 placed on the machine table 6 so as to be extended in an X axial direction and are structured movably in the X axial direction by this moving table 43. The maintenance device 3 has a volume measuring device 4 measuring a volume of the functional droplet discharged by the droplet discharging heads 11, and the volume measuring device 4 is mounted not on the moving table 43 but on the drawing device 2. The volume measuring device 4 is described layer.

The storage unit 21 has a sealing cap 22 which is brought into close contact with the nozzle surfaces 12 of the droplet discharging heads 11, and the sealing cap 22 is attached to the moving table 43 via a sealing cap lifting mechanism 23. During non-operation time of the droplet discharging device 1, the droplet discharging heads 11 move to a maintenance position on the moving table 43, and with respect to this, the sealing cap 22 is lifted to bring into close contact with the nozzle surfaces 12 of the droplet discharging heads 11. That is, all the nozzles 13 of the droplet discharging heads 11 are sealed to reduce or prevent the functional droplet in the respective nozzles 13 to be dried. This suppresses an increase in viscosity of the functional liquid and reduces or prevents so-called nozzle clog.

The sucking unit 31 has a suction cap 32 which is brought into close contact with the nozzle surfaces 12 of the droplet discharging heads 11, and the suction cap 32 is attached to the moving table 43 via a suction cap lifting mechanism 33. Furthermore, to the suction cap 32, the sucking pump not shown in the figure is connected. When the functional liquid is charged into the droplet discharging heads 11, or when the functional liquid with an increased viscosity is sucked, this suction cap 32 is lifted to be brought into close contact with the droplet discharging heads 11 to carry out the pump suction. When the discharge (drawing) of the functional droplet is ceased, the droplet discharging heads 11 are driven to carry out the flashing (waste discharge). At this time, the suction cap 32 is slightly spaced from the droplet discharging heads 11 to receive the flashing. This reduces or prevents nozzle clog and allows the droplet discharging heads 11 with the nozzle clog occurred to recover their function.

The wiping unit 41 is provided with a wiping sheet 42 which can be freely fed and wound, and while sending the fed wiping sheet 42 and moving the wiping unit 41 in the X axial direction by the moving table 43, the nozzle surfaces 12 of the droplet discharging heads 11 are wiped off. Thereby, the functional liquid adhering to the nozzle surfaces 12 of the droplet discharging heads 11 is removed, so that flight curve during discharge of the functional droplet or the like is reduced or prevented. As the maintenance device 4, in addition to each of above-mentioned units, a discharge checking unit checking a flight state of the functional droplet discharged from the droplet discharging heads 11 or the like, are preferably mounted.

As shown in FIG. 1, the drawing device 2 has an X/Y moving mechanism 61 set up in a crisscross shape on the machine table 6. The X/Y moving mechanism 61 relatively moves the work W in the X axial direction and in a Y axial direction with respect to the droplet discharging heads 11, and has an X axial table 62 mounting the work W and a Y axial table 71 set up in such a manner as to extend across and perpendicular to the X axial table 62 and mounting the droplet discharging heads 11. Furthermore, the drawing device 2 includes a head recognizing camera (omitted in the figure) performing position recognition of the droplet discharging heads 11, a work recognizing camera (omitted in the figure) to perform position recognition of the work W, and various devices such as the volume measuring device 4.

The work W is composed of a transmissive (transparent) glass substrate with electrodes or the like made therein, whose surface is divided into a plurality of drawing regions D for making pixels therein and a non-drawing region S.

The functional droplet is discharged to these drawing regions D to perform drawing. Furthermore, according to the present exemplary embodiment, the functional droplet to measure is discharged in this non-drawing region S by the droplet discharging heads 11 to measure discharging liquid amounts of the respective nozzles. Specifically, a surface of the non-drawing region S corresponds to a horizontal plane according to claims, and the volume of the functional droplet touching down on this part is measured by the volume measuring device 4. The measuring substrate composing the above-mentioned horizontal plane may be structured to be provided in the drawing device 2 as a separate body from the work W.

The X axial table 62 is directly set up on the machine table 6 so as to be mutually parallel with the maintenance device 3 extending in the X axial direction, and has a set table 66 composed of the adsorption table 63 adsorbing the work W and a θ table 64 supporting the adsorption table 63 rotatably around a Z axis, an X axial slider 65 supporting the set table 66 slidably in the X axial direction, and an X axial motor (omitted in the figure) driving the X axial slider 65. The work W can be adsorbed and placed on the adsorption table 63 and be moved in the X axial direction which is a main scanning direction, via the X axial slider 65.

The Y axial table 71 has a bilateral pair of columnar supports 72 provided upright on the machine table 6 with the X axial table 62 interposed, a Y axial frame 73 provided so as to be bridged between both the columnar supports 72, a Y axial slider 74 supported slidably by the Y axial frame 73, a Y axial motor (omitted in the figure) driving the Y axial slider 74, and a main carriage 75 supported by the Y axial slider 74 and mounting the droplet discharging heads 11. In the main carriage 75, a head unit 76 is provided vertically, and in the head unit 76, the three droplet discharging heads 11 for R color, G color and B color via a sub carriage (omitted in the figure).

The droplet discharging heads 11 each have many nozzles 13 (for example, 180 nozzles) discharging the functional droplet in the nozzle surfaces 12, and the many nozzles 13 form nozzle rows 14.

The three droplet discharging heads 11 for R, G and B are arranged on the head unit 76 transversely with respect to the X axial direction so that the nozzle rows 14 are perpendicular to the main scanning direction.

When the work W is drawn, the functional droplet discharging heads 11 (head unit 76) have been made to face the work W, and the functional droplet discharging heads 11 are driven for discharge in synchronization with the main scanning (reciprocating movement of the work W) by the X axial table 62. Furthermore, sub scanning (movement of the head unit 76) is performed by the Y axial table 71 as necessary. By this series of operations, selective discharge of the desired functional droplet that is, drawing to the drawing regions D of the work W is performed.

Furthermore, when the maintenance of the droplet discharging heads 11 is performed, the suction unit 31 is moved to the predetermined maintenance position by the moving table 43, and the head unit 76 is moved to the above-mentioned maintenance position by the Y axial table 71 to perform the flashing of the droplet discharging heads 11 or the pump suction. In the case where the pump suction is performed, the wiping unit 41 is subsequently moved to the maintenance position by the moving table 43 to perform wiping of the droplet discharging heads 11. Similarly, when the work is completed and the operation of device is stopped, capping is performed for the droplet discharging heads 11 by the storage unit 21.

Figure 2:
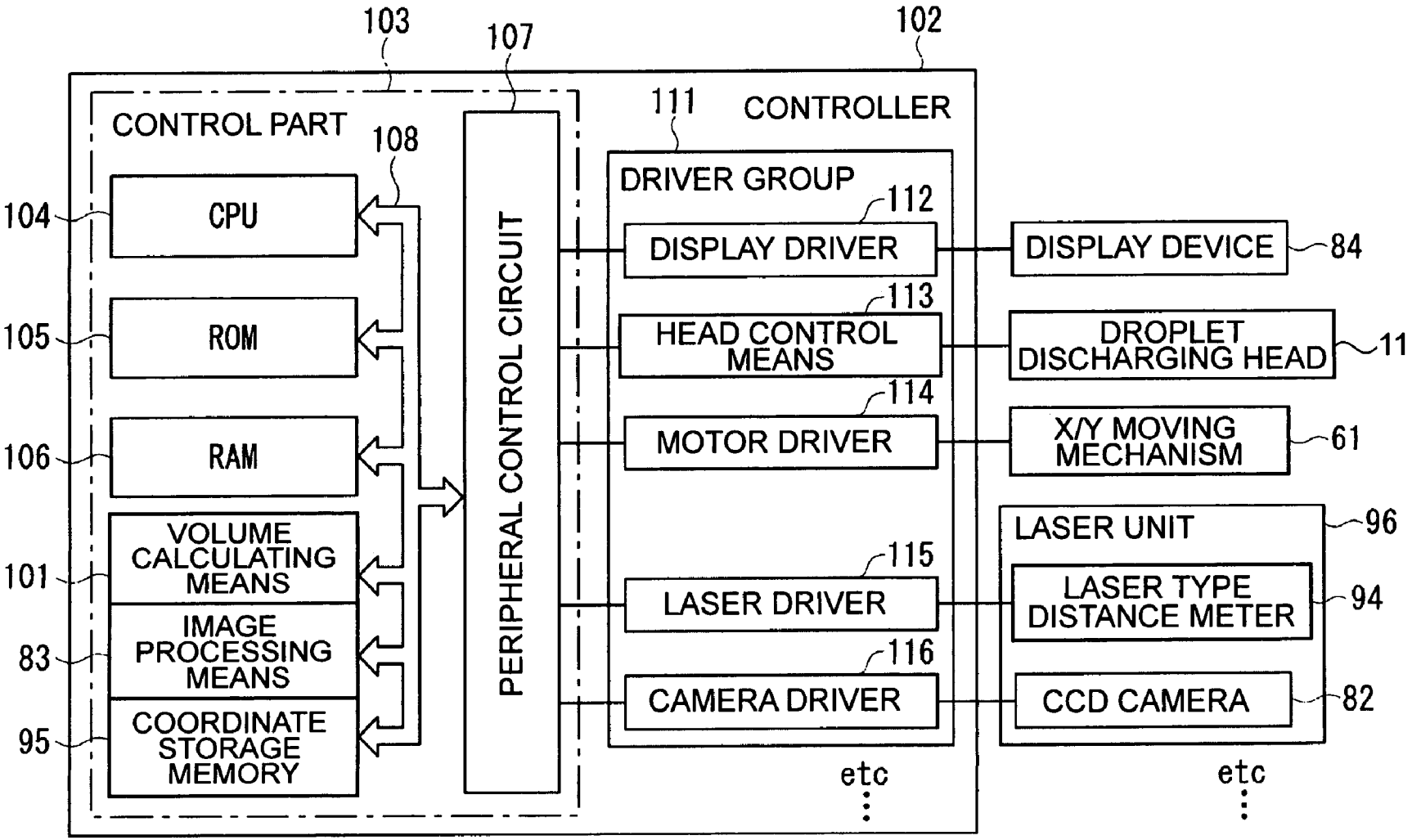
FIG. 2 is a schematic block diagram showing a controller which is a main control system of the droplet discharging device.
Figure 3:
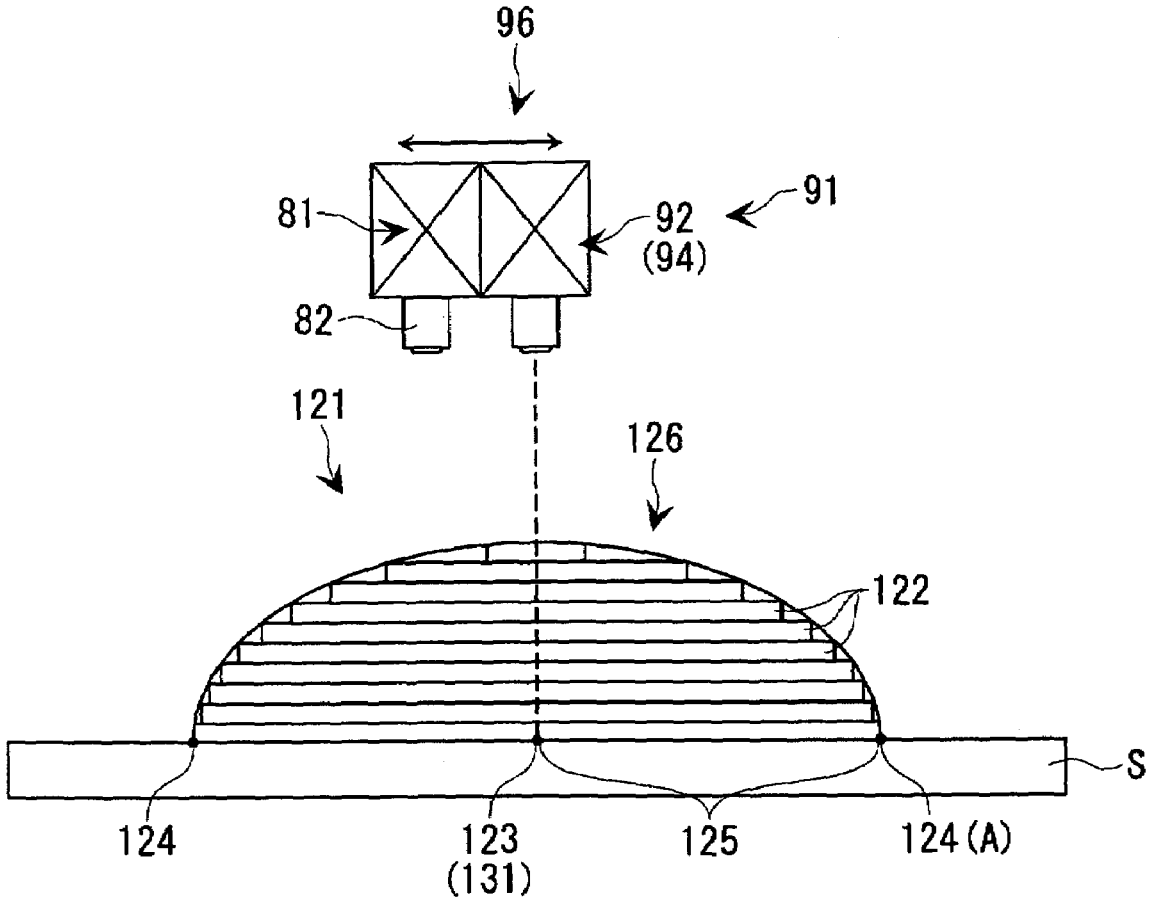
FIG. 3 is a side elevational schematic view showing a concept of a volume measuring method of a droplet of the exemplary embodiment.

Next, referring to FIG. 3, a detailed description of the volume measuring device 4 is given. The volume measuring device 4 measures a volume of a droplet (a functional droplet) 121 dropped on a horizontal plane, and has an image recognizing device 81 acquiring a central point in horizontal plane view 123 of the droplet 121 as origin coordinates 131, a coordinate measuring device (electromagnet device) 91 measuring outline coordinates 126, which are coordinates of a surface of the droplet 121, at a plurality of positions, and a volume calculating device 101 (composed of a part of the controller 102) calculating the volume of the droplet based on the measured outline coordinates 126 (refer to FIG. 2). The above-mentioned coordinate measuring device 91 includes a measuring device 92 measuring the outline coordinates and scanning device 93 making the measuring device 92 scan, and in the present exemplary embodiment, the scanning device 93 is composed of the X/Y moving mechanism 61.

As shown in the same figure, the image recognizing device 81 has a CCD camera 82 with an illumination lamp which images the droplet 121 dropped in the non-drawing region S, and image processing device 83 (composed of a part of the controller 102) image processing a recognition image (omitted in the figure) image-recognized by the CCD camera 82 (refer to FIG. 2). Furthermore, the measuring device 92 includes a laser type distance meter 94 and a coordinate storage memory 95 (composed of a part of the controller 102) (refer to FIG. 2). The laser type distance meter 94 has a laser oscillator therein (omitted in the figure) and with laser light used as measuring light, a phase of reflected light thereof is used to measure a height of the outline coordinates 126 (Z coordinate). Among them, the CCD camera 82 and the laser coordinate meter 94 are integrally configured as a laser unit 96, which is located in a lateral direction of the droplet discharging heads 11 and mounted on the above-mentioned head unit 76 (refer to FIG. 1).

As shown in FIG. 2, the image processing device 83 includes so-called image processing software incorporated into the controller 102, and performs image processing of the recognition image imaged by the CCD camera 82. Concrete image processing work is described later. Similarly, the coordinate storage memory 95 is a so-called hard disk incorporated into the controller 102, and outline coordinate data once stored in this coordinate storage memory 95 is read out by the above-mentioned volume calculating device 101 as necessary.

Next, referring to FIG. 2, a description of control by the controller 102 of the droplet discharging device 1 of the present exemplary embodiment is given. The controller 102 has a control part 103 performing overall control over the respective component devices of the droplet discharging device 1 directly or indirectly via various drivers, and a driver group 111 directly taking on driving of each of these component devices.

The control part 103 has a CPU 104 composed of a micro processor, a ROM 105 storing various control programs, a RAM 106 serving as a main storage device, and the volume calculating device 101 which is software installed in the hard disk and calculates the volume of the functional droplet, the image processing device 83 which is also image processing software and image processes the imaging recognition image, the coordinate storage memory 95, and a peripheral control circuit 107 which allows these to communicate with the driver group 111, and these components are coupled to each other via an internal bus 108.

The driver group 111 is composed of various drivers such as a display driver 112 to display a display device 84, a head control device 113 to control the discharge of the droplet discharging heads 11, a motor driver 114 to drive the X/Y moving mechanism 61, a laser driver 115 driving the laser coordinate meter 94, and a camera driver 116 driving the CCD camera 82.

In the above-mentioned controller 102, the CPU 104 instructs the imaging of the droplet 121 to the CCD camera 82 via the camera driver 116, and the imaging recognition image is image processed via the image processing device 83. Similarly, the CPU 104 makes the laser type distance meter 94 to measure the outline coordinates 126 via the laser driver 115, and gives an instruction to store the measured coordinate data in the coordinate storage memory 95. In this case, the CPU 104 gives an instruction to drive the X/Y moving mechanism 61 via the motor driver 114 to relatively move the above mentioned laser type distance meter 94 with respect to the droplet 121. In this manner, the controller 102 (CPU 104) overall controls the respective component devices of the droplet discharging device 1.

Next, referring to FIG. 3, a volume measuring method of a droplet is schematically described. The droplet (functional droplet) 121 discharged from the droplet discharging heads 11 touches down in the above-mentioned non-drawing region S to be formed into a semispherical shape rotation-symmetrical with respect to a central axis. The semispherical shape of the droplet 121 can be considered to be structured by piling up thin cylinders 122 having the same central axis. The present exemplary embodiment employs a method in which a sum of volumes of the plurality of cylinders 122 is calculated to obtain the volume of the droplet 121. As a matter of course, a direction in which the droplet 121 are segmentized is not limited to the above-mentioned dividing method of the horizontal direction.

In the volume calculating method of the present exemplary embodiment, the central point in horizontal plane view 123 which is the center of the droplet 121 is first acquired by the image recognizing device 81, the coordinate measuring device 91 recognizes the central point in horizontal plane view 123 as the origin coordinates 131, and based on the origin coordinates 131, the outline coordinates 126 are measured to thereby measure the volume of the droplet 121. This measurement of the outline coordinates 126 only needs a radius and a height of each of the cylinders 122 mentioned above, and thus only a line segment 125 (a part corresponding to the radius in horizontal plane view) connecting the central point in horizontal plane view 123 and one arbitrary point A of an outer periphery 124 of the droplet 121 is scanned (in the present exemplary embodiment, scanned in the X axial direction) (refer to FIG. 3). The central point in horizontal plane view according to the claims denotes a central point on the non-drawing region S (on the horizontal plane), not a central point on the surface of the droplet 121.

Next, a flow of concrete volume measuring work is described. The volume measuring work includes acquiring the origin coordinates 131 by the image recognition device 81, measuring coordinates of the surface of the droplet 121 by the coordinate measuring device 91, and calculating the volume of the droplet 121 by the volume calculating device 101.

Figure 4:
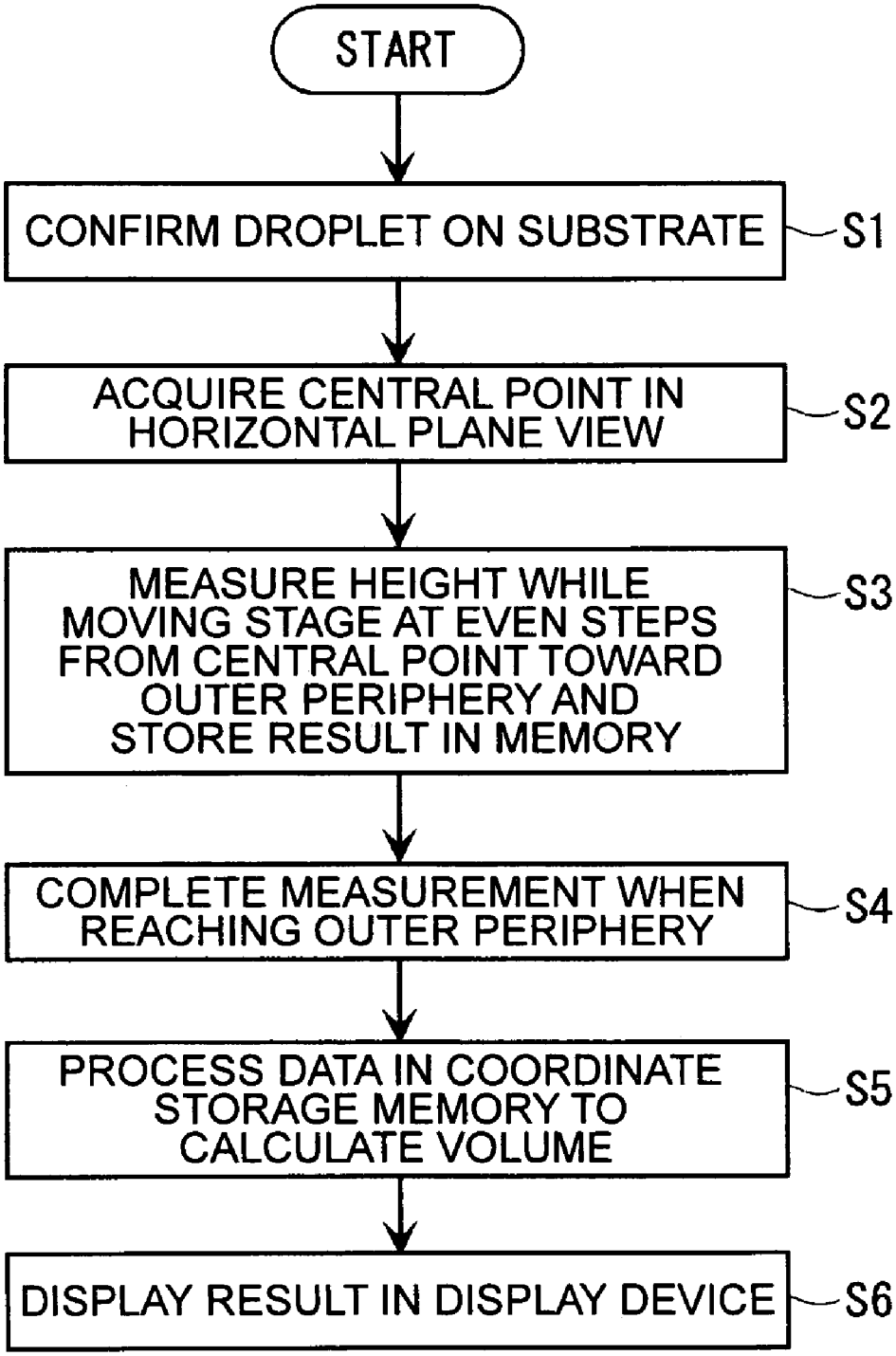
FIG. 4 is a flowchart explaining a volume calculation process of the droplet.

As shown in FIG. 4, in regard to the droplet 121 dropped in the non-drawing region S, in the origin coordinate acquiring a position on the non-drawing region S and the outline of the droplet 121 are image-recognized based on the recognition image (omitted in the figure) imaging by the image recognition device 81 (S1). Here, by the image processing device 83, the recognition image is binarized into a droplet image (omitted in the figure) and a peripheral image (omitted in the figure) in black and white to determine the outline of the droplet 121. Based on this recognized outline, the central point in horizontal plane view 123 of the droplet 121 is acquired (S2). From this recognition result, in the case of the droplet 121 having a deformation amount of 5% or more with respect to a perfect circle, error information is given as a warning sound or a warning message on a screen of the display device 84.

Next, recognition work of the origin coordinates 131 is described. In the recognition work, the laser type distance meter 94 is first aligned by the X/Y moving mechanism 61 so that the laser type distance meter 94 is located vertically above the central point in horizontal plane view 123 of the droplet 121. After the alignment, the laser type distance meter 94 performs zero point correction based on the central point in horizontal plane view 123. Thereby, the controller 102 recognizes the central point in horizontal plane view 123 as the origin coordinates 131. This recognition work is a so-called zero point correction, in which the laser type distance meter 94 performs correction with a measured height of the origin coordinates 131 (Z coordinate) defined as zero, and a position (X coordinate and Y coordinate) where the laser type distance meter 94 is supported by the X/Y moving mechanism 61 is recognized as zero.

After the zero point correction, the process shifts to the coordinate measuring and the outline coordinates 126 of the droplet 121 vertically above the central point in horizontal plane view 123 is measured. Next, at a measuring position moving from the above-mentioned central point in horizontal plane view 123 in a diameter direction of the droplet 121, for example, at a measuring position moving by 1 μm in the X axial direction of the X axial table 62, the layer type distance meter 94 measures the outline coordinates immediately thereunder. This measured coordinate data is sequentially stored in the coordinate storage memory 95 (S3). Similarly, at each measuring position moving by 1 μm in the X axial direction at even intervals, the coordinate measurement is carried out, and this measurement work is repeated to measure the coordinates up to the outer periphery 124 of the droplet 121 and to store the coordinate data. In this case, when the height (Z coordinate) of the outline coordinates 126 continuously measures 0.1 μm or less (that is, zero), it is judged that the outer periphery 124 of the droplet 121 is reached and the coordinate measurement is completed (S4) (refer to FIG. 5).

When the above-mentioned coordinate measurement (scanning) in the X axial direction is completed, in the same manner, with only the scanning direction changed, scanning in the Y axial direction, for example, is performed for the coordinate measurement, the coordinates are measured from the central point in horizontal plane view 123 to the outer periphery 124 of the droplet 121, and the coordinate data is stored. Such coordinate measurement in which the scanning direction is changed is carried out several times, and an average value of the outline coordinates 126 of the droplet 121 is obtained to guarantee the precision of the volume calculation.

Next, the process shifts to the volume calculating of actually calculating the volume. First, calculating work of the average value is performed. Specifically, in between the respective scanning directions, an average value of the height for each measuring position (that is, each of the positions whose distances from the central point in horizontal plane view 123 are equal) of the above-mentioned coordinate data is calculated, and as shown in FIG. 5, positions on the surface of the droplet 121 are output as a table showing the distances from the central point in horizontal plane view 123 and the average values of the height. A character n in FIG. 5 corresponds to a radius (μm) of the droplet 121, in this case.

From values in the table shown in FIG. 5, volumes of the thin cylinders 122 are added up as described above, to thereby calculate the volume of the droplet 121 (S5 in FIG. 4). A calculation formula of a volume (V) of the droplet 121 is as follows:

$$V=\Sigma\pi Rn^2Hn$$

Where

Rn: a radius of the cylinder 122,

Hn: a height of the cylinder 122.

The calculation result is displayed in the display device 84 (S6 in FIG. 4).

In the above-mentioned scanning in the diameter direction of the droplet 121, the respective measuring positions are set at even intervals of 1 μm, however, a structure in which fine coordinate measurement can be performed in the vicinity of the outer periphery 124 can also be employed. More specifically, in the vicinity of the central point in horizontal plane view 123 of the droplet 121 where change in height is smaller, the coordinate measurement is performed at even intervals of 1 μm, and in the vicinity of the outer periphery 124 where change in height is larger, the measurement is performed at fine intervals of about 0.1 μm, for example. Preferably, the measurement interval is gradually reduced toward the outer periphery 124 to perform the measurement. Thereby, in regard to the volume in the vicinity of the outer periphery 124 of the droplet 121 where the change amount in height (Z coordinate) is large, more precise volume calculation is enabled and the measurement precision is enhanced or improved.

The above-mentioned work (operation) is performed for the droplet 121 discharged from all the nozzles 13. In this case, for example, the droplet 121 for measurement has been discharged from all the nozzles 13 of the droplet discharging heads 11 and correspondingly, the coordinate measurement is performed while moving the laser type distance meter 94 in the X axial direction and the Y axial direction.

Furthermore, based on the volume measurement result as described above, the volume of the droplet (functional droplet) 121 discharged from the respective nozzles 13 of the droplet discharging heads 11 can be uniformized. In the present exemplary embodiment, discharging liquid amounts (volumes) of the respective nozzles 13 are calculated, and the nozzles 13 having the discharging liquid amount deviating from an average value of them, are the object of uniformization. The uniformization work is performed by adjusting a voltage applied to a piezoelectric actuator (omitted in the figure) which drives the discharge of the droplet 121 of the nozzles 13 by pumping action. However, in this case, a drive waveform of the nozzles 13 to be uniformized is corrected via the head control device 113 to adjust the discharging liquid amount.

According to the present exemplary embodiment as described above, the image recognition device 81 acquires the central point in horizontal plane view 123 of the functional droplet, and thereby, the measuring device 92 can measure the coordinates of the line segment 125 connecting the central point in horizontal plane view 123 of the functional droplet and the one arbitrary point A of the outer periphery 124, thereby shortening volume calculating time. Therefore, the volume of the functional droplet discharged from the droplet discharging heads 11 can be calculated in a short period of time, and a measurement error caused by evaporation of the functional droplet does not affect the volume calculation precision. Furthermore, by correcting the drive waveforms of the nozzles 13 based on the calculated volume, adjustment can be performed so that the discharging liquid amounts of the droplet discharging heads 11 are uniform.

Next, as an electro-optic device (flat panel display) manufactured using the droplet discharging device 1 of the present exemplary embodiment, taking a color filter, a liquid crystal display device, an organic EL device, a plasma display (PDP device), an electron emission device (an FED device and an SED device), an active matrix substrate with these display devices and the like formed as examples, structures and manufacturing methods of these are described. The active matrix substrate denotes a substrate in which a thin film transistor, and a source line and a data line electrically coupled to the thin film transistor are formed.

Figure 6:
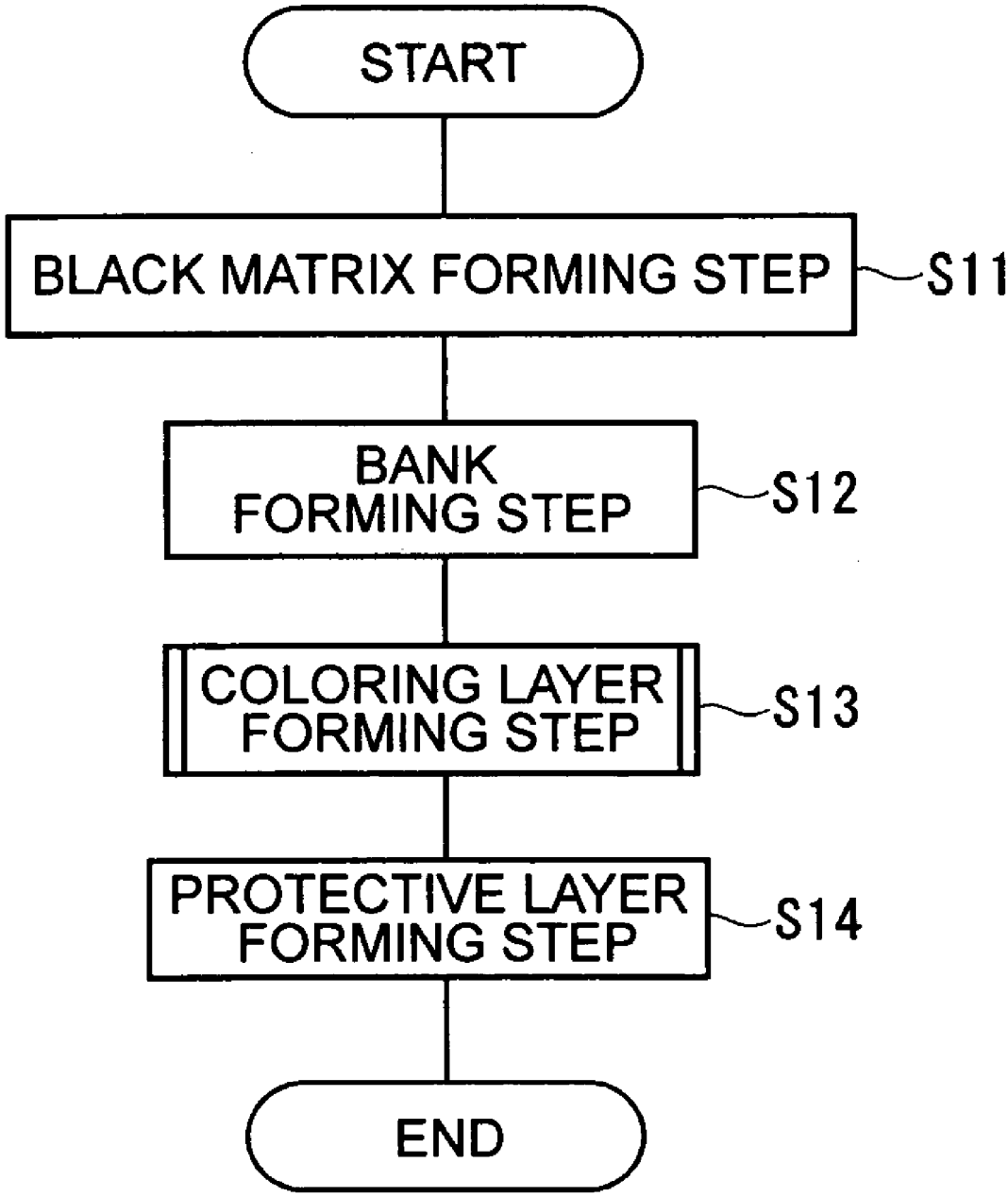
FIG. 6 is a flowchart explaining a color filter manufacturing process.

Firstly, a manufacturing method of a color filter incorporated into a liquid crystal display device, an organic EL device or the like is described. FIG. 6 is a flowchart showing manufacturing steps of the color filter, and FIGS. 7A–E are schematic cross-sectional views of a color filter 500 (a filter base body 500A) of the present exemplary embodiment shown in the order of the manufacturing steps.

Figure 7A:
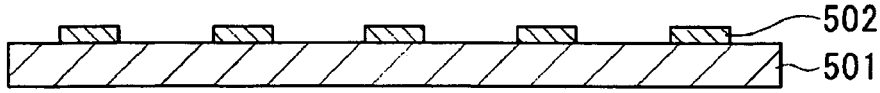
FIGS. 7A to 7E are schematic cross-sectional views sharing the color filter shown in the manufacturing process order.

Firstly, in the black matrix forming step (S11), as shown in FIG. 7A, black matrixes 502 are formed on a substrate (W) 501. The black matrixes 502 are formed of chromium metal, a multi-layered body of chromium metal and chromium oxide, resin black or the like. In order to form the black matrixes 502 made of metal thin film, a sputtering method, a vapor deposition method or the like can be used. Furthermore, in the case where the black matrixes 502 made of resin thin film are formed, a gravure printing method, a photo resist method, a thermal transfer method or the like can be used.

Figure 7B:
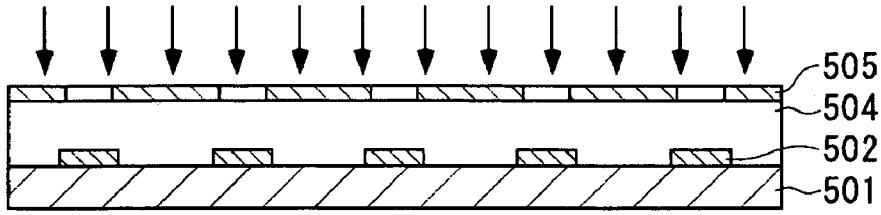

Subsequently, in the bank forming step (S12), banks 503 are formed in a state of superposing themselves on the black matrixes 502. Specifically, as shown in FIG. 7B, a resist layer 504 made of a negative transparent photosensitive resin is formed so as to cover the substrate 501 and the black matrixes 502. In addition, in a state that an upper surface of the resist layer 504 is coated with a mask film 505 formed into a matrix pattern shape, exposure treatment is performed.

Figure 7C:
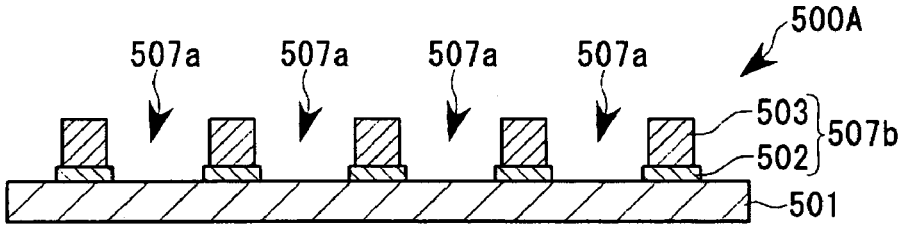

Furthermore, as shown in FIG. 7C, unexposed parts of the resist layer 504 are subjected to etching treatment to thereby pattern the resist layer 504, thereby forming the banks 503. In the case where the black matrixes are formed of the resin black, the black matrixes also serve as the banks.

These banks 503 and the black matrixes 502 under the banks 503 serve as partition wall parts 507*b* demarcating respective pixel regions 507*a*, which define touching down regions of the functional droplet when forming coloring layers (film formation parts) 508R, 508G, and 508B by the droplet discharging heads 11 in the coloring layer forming described later.

Via the above-mentioned black matrix forming and the bank forming, the above mentioned filter base body 500A is obtained.

In the present exemplary embodiment, as a material of the banks 503, a resin material whose coating surface becomes lyophobic (hydrophobic) is used. Since a surface of the substrate (glass substrate) 501 is lyophilic (hydrophilic), the precision of a touching down position of the droplet in the respective pixel regions 507*a* surrounded by the banks 503 (partition wall parts 507*b*) is enhanced or improved in the coloring layer forming described later.

Figure 7D:
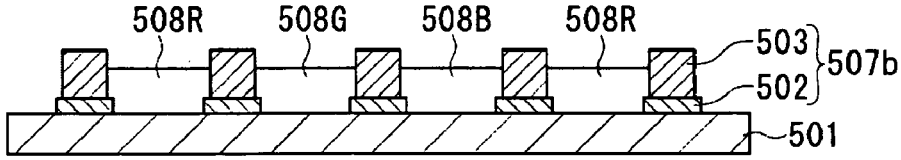

Next, in the coloring layer forming step (S13), as shown in FIG. 7D, the functional droplet is discharged by the droplet discharging heads 11 to touch down it in each of the pixel regions 507*a* surrounded by the partition wall parts 507*b*. In this case, using the droplet discharging heads 11, the functional liquids of three colors of R, G and B (filter materials) are introduced to discharge the functional droplet. As an arrangement pattern of the three colors of R, G and B, there are strive arrangement, mosaic arrangement and delta arrangement, or the like.

Figure 7E:
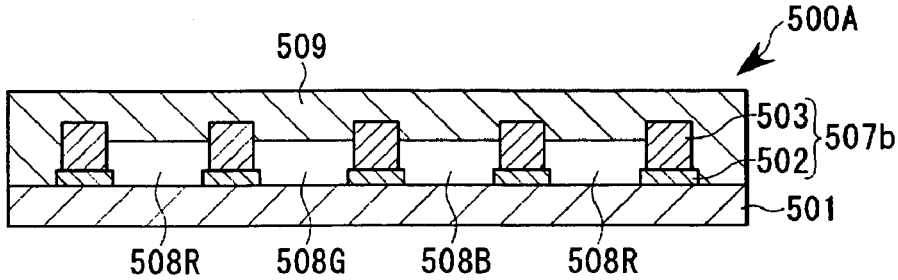

Thereafter, via a drying treatment (treatment such as heating), the functional liquids are fixed to form the coloring layers of three colors 508R, 508G and 508B. After the coloring layers 508R, 508G, and 508B are formed, the process shifts to the protective film forming step (S14), and as shown in FIG. 7E, a protective film 509 is formed so as to cover upper surfaces of the substrate 501, the partition wall parts 507*b*, and the coloring layers 508R, 508G, and 508B.

In other words, an application liquid for the protective film is discharged on the entire surface of the substrate 501 where the coloring layers 508R, 508G and 508B are formed and thereafter, the protective film 509 is subjected to the drying treatment to be formed.

After the protective film 509 is formed, the color filter 500 shifts to the film forming of forming ITO (Indium Tin Oxide) or the like which makes into a transparent electrode in the next step.

Figure 8:
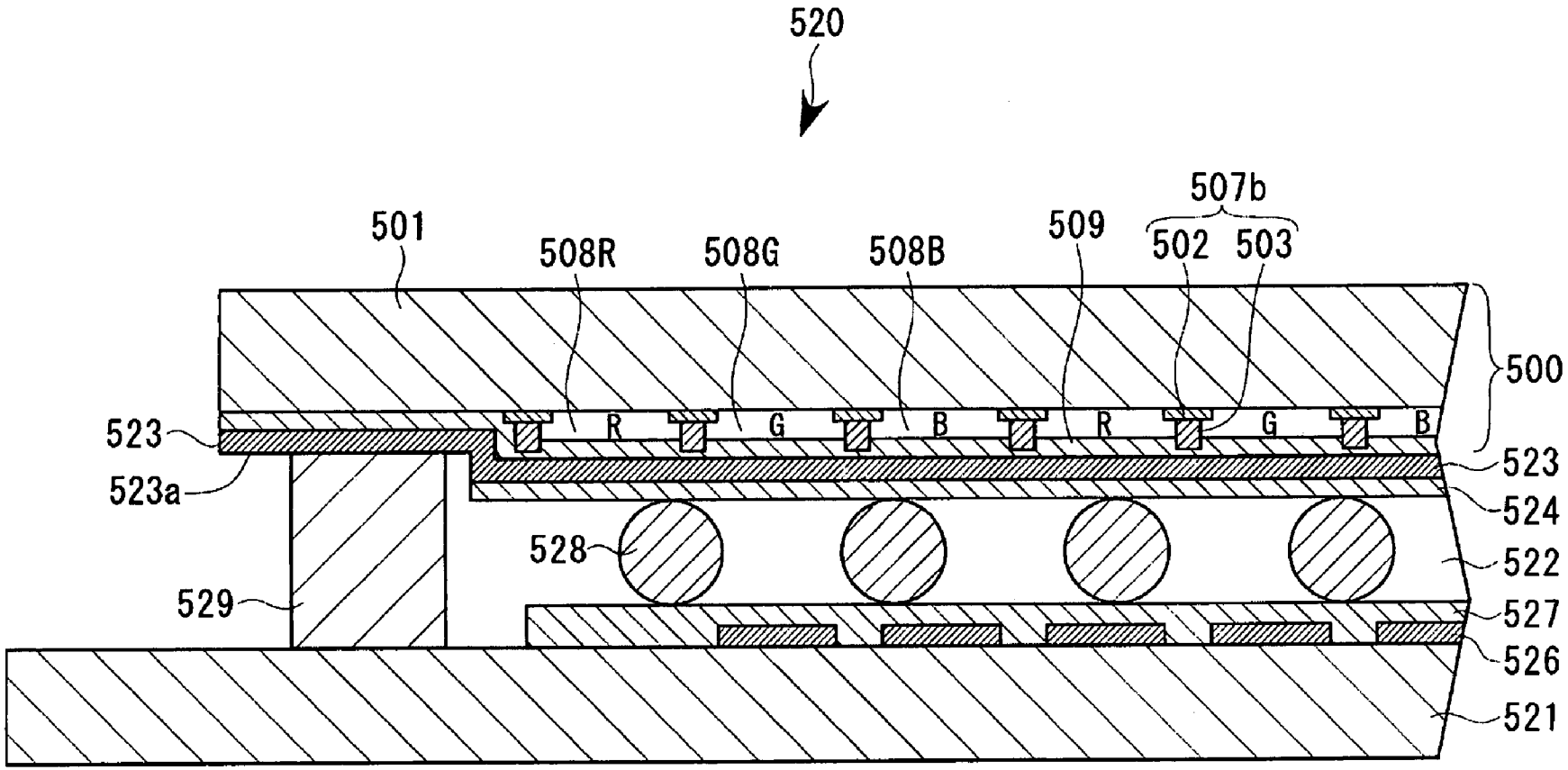
FIG. 8 is a substantial part cross-sectional view showing a schematic structure of a liquid crystal device using a color filter applying the present invention.

FIG. 8 is a substantial part cross-sectional view showing a schematic structure of a passive matrix type liquid crystal device (liquid crystal device) as one example of a liquid crystal display device using the above-mentioned color filter 500. By mounting accessory elements such as an IC for driving liquid crystal, a back light and a supporting body on this liquid crystal device 520, a transmissive type liquid crystal display device as an end product can be obtained. Since the color filter 500 is the same as that shown in FIG. 7, corresponding parts are indicated by the same reference numerals and a description thereof is omitted.

This liquid crystal device 520 is schematically composed of the color filter 500, an counter substrate 521 made of a glass substrate or the like, and a liquid crystal layer 522 made of an STN (Super Twisted Nematic) liquid crystal composition held between these, and the color filter 500 is arranged on the upper side of the figure (on the side of an observer).

Although not shown in the figure, polarizing plates are arranged on outer surfaces of the counter substrate 521 and the color filter 500 (surfaces on the opposite side of the liquid crystal layer 522), respectively, and outside of the polarizing plate located on the counter substrate 521 side, a back light is arranged.

On the protective film 509 (on the liquid crystal layer side) of the color filter 500, a plurality of first electrodes 523 in long stripes in a lateral direction in FIG. 8 are formed at predetermined intervals, and a first orientation film 524 is formed so as to cover the surfaces of these first electrodes 523 on the opposite side of the color filter 500.

On the other hand, on a surface opposed to the color filter 500 in the counter substrate 521, a plurality of second electrodes 526 in long stripes in a direction perpendicular to the first electrodes 523 of the color filter 500 are formed at predetermined intervals, and a second orientation film 527 is formed so as to cover surfaces of these second electrodes 526 on the liquid crystal layer 522 side. These first electrodes 523 and the second electrodes 526 are formed of a transparent conductive material such as ITO.

Spacers 528 provided in the liquid crystal layer 522 are members for keeping a thickness (cell gap) of the liquid crystal layer 522 constant. Furthermore, a seal material 529 is a member to reduce or prevent the liquid crystal composition in the liquid crystal layer 522 from leaking out to the outside. One end part of the first electrodes 523 extends to the outside of the seal material 529 as pull-around wiring 523*a*.

In addition, parts where the first electrodes 523 and the second electrodes 526 intersect are pixels, and in these parts serving as pixels, the coloring layers 508R, 508G and 508B of the color filter 500 are located to be structured.

In a normal manufacturing process, with respect to the color filter 500, patterning of the first electrodes 523 and application of the first orientation film 524 are performed to produce a part on the color filter 500 side. With respect to the counter substrate 521, patterning of the second electrodes 526 and application of the second orientation film 527 are performed to produce a part on the counter substrate 521 side. Thereafter, the spacers 528 and the seal material 529 are made in the part on the counter substrate 521 side, to which the part on the color filter 500 side is stuck in this state. Next, the liquid crystal composing the liquid crystal layer 522 is injected from an injection opening of the seal material 529 and the injection opening is closed. Then, both of the polarizing plates and the back light are deposited.

The droplet discharging device 1 of the present exemplary embodiment can apply a spacer material (functional liquid) constructing the above-mentioned cell gap, for example, and before sticking the part on the color filter 500 side to the part on the counter substrate 521 side, can uniformly apply the liquid crystal (functional liquid) to the region encompassed by the seal material 529. Furthermore, printing of the above-mentioned seal material 529 can be performed by the droplet discharging heads 11. Still furthermore, application of both the first and second orientation films 524 and 527 can be performed by the droplet discharging heads 11.

Figure 9:
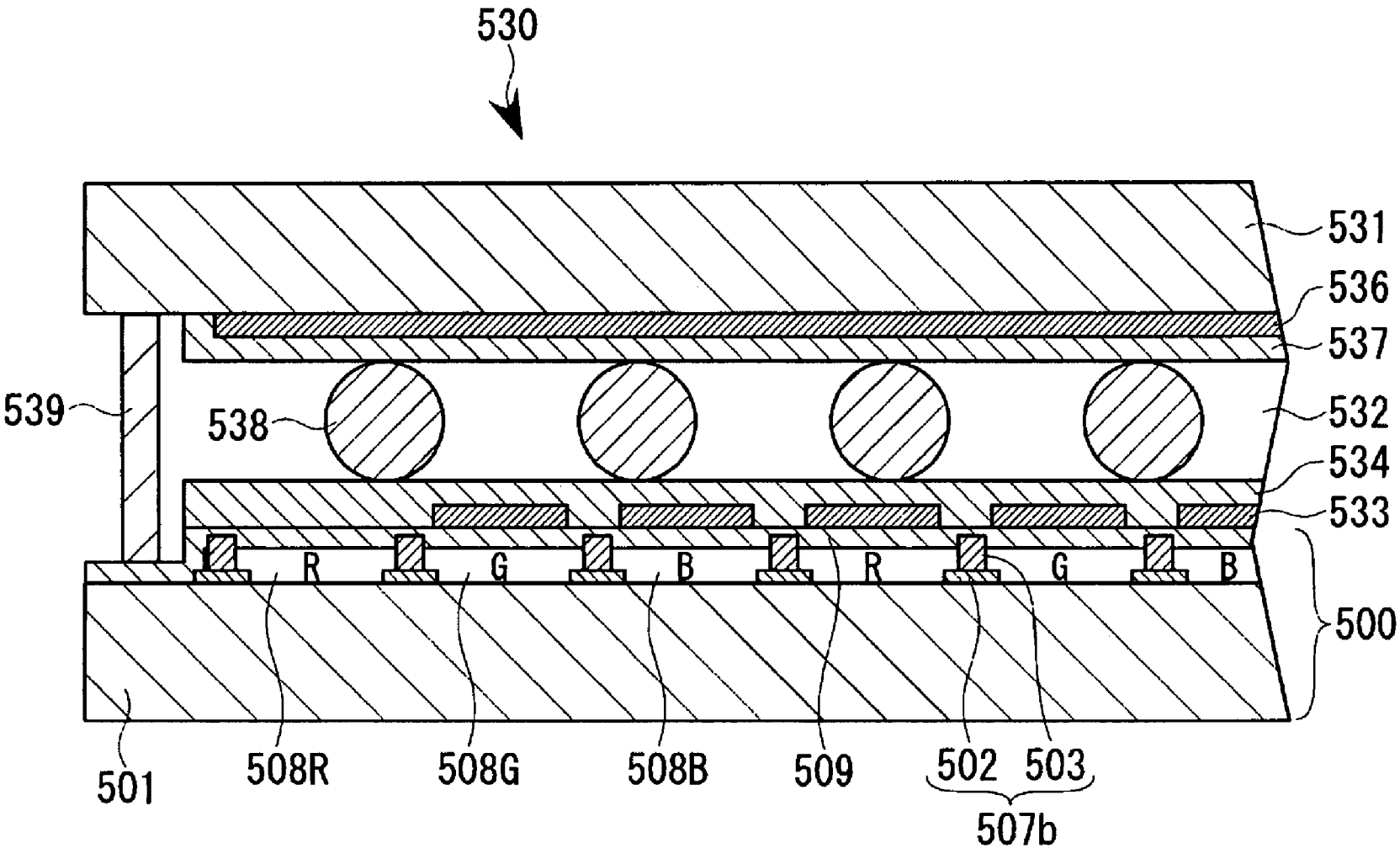
FIG. 9 is a substantial part cross-sectional view showing a schematic structure of a liquid crystal device of a second exemplary embodiment using a color filter applying the present invention.

FIG. 9 is a substantial part cross-sectional view showing a schematic structure of a second example of a liquid crystal device using the color filter 500 manufactured in the present exemplary embodiment.

A significant different point of this liquid crystal device 530 from the above-mentioned liquid crystal device 520 is that the color filter 500 is arranged on the lower side of the figure (opposite side of an observer).

This liquid crystal device 530 is schematically structured such that a liquid crystal layer 532 made of an STN liquid crystal is held between the color filter 500 and an counter substrate 531 made of a glass substrate or the like. Although not shown in the figure, polarizing plates or the like are arranged on outer surfaces of the counter substrate 531 and the color filter 500, respectively.

On the protective film 509 of the color filter 500 (on the liquid crystal layer 532 side), a plurality of first electrodes 533 in long stripes in a depth direction in the figure are formed at predetermined intervals, and a first orientation film 534 is formed so as to cover surfaces of the first electrodes 533 on the liquid crystal layer 532 side.

On a surface of the counter substrate 531 opposed to the color filter 500, a plurality of second electrodes 536 in long stripes extending in a direction perpendicular to the first electrodes 533 on the color filter 500 side are formed at predetermined intervals, and a second orientation film 537 is formed so as to cover surfaces of the second electrodes 536 on the liquid crystal layer 532 side.

In the liquid crystal layer 532, there are provided spacers 538 to keep a thickness of the liquid crystal layer 532 constant, and a seal material 539 to prevent the liquid crystal composition in the liquid crystal layer 532 from leaking out to the outside.

In addition, as in the above-mentioned liquid crystal device 520, parts where the first electrodes 533 and the second electrodes 536 intersect are pixels, and in these parts serving as pixels, the coloring layers 508R, 508G and 508B of the color filter 500 are located to be structured.

Figure 10:
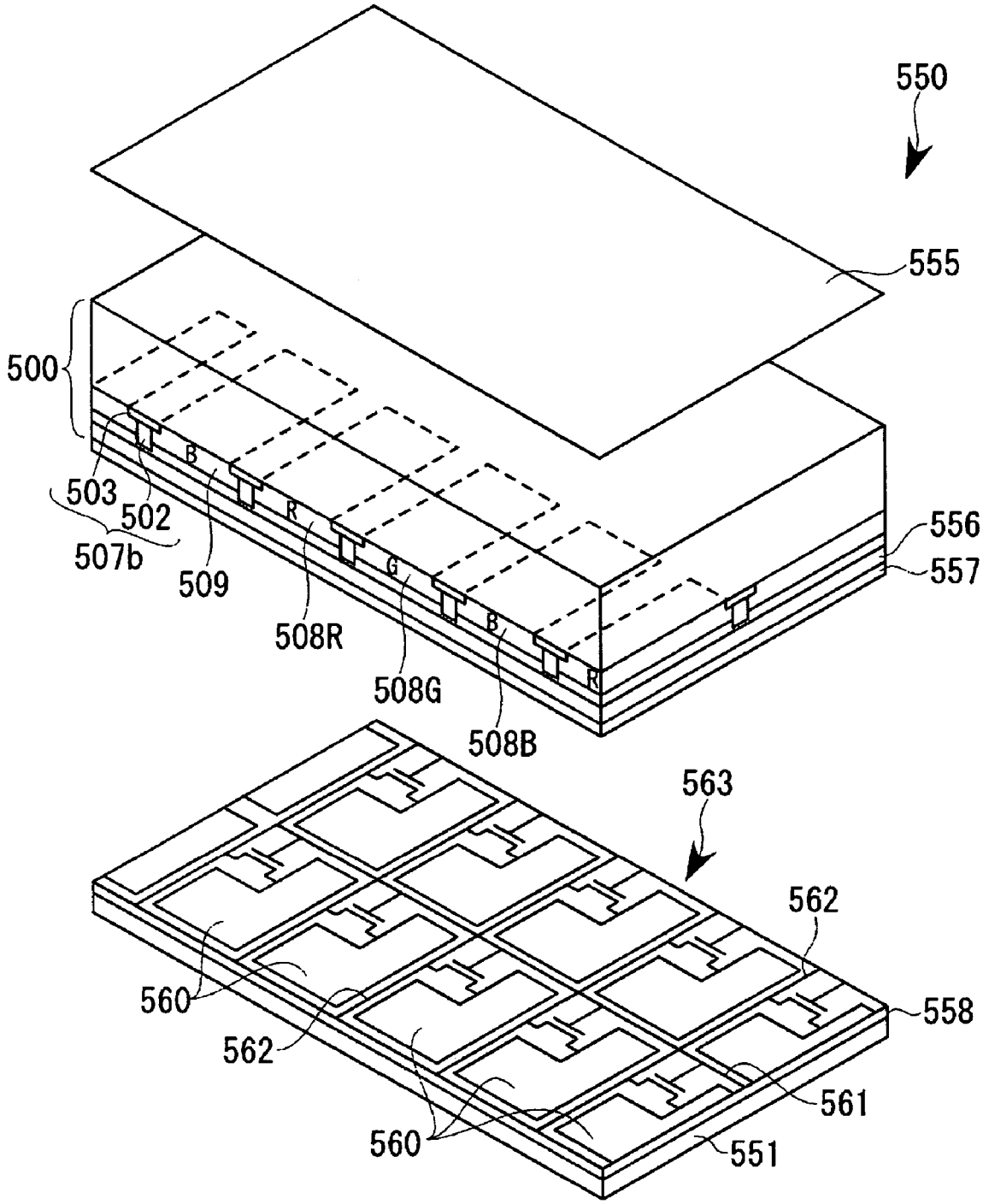
FIG. 10 is a substantial part cross-sectional view showing a schematic structure of a liquid crystal device of a third example using a color filter applying the present invention.

FIG. 10 shows a third example in which a liquid crystal device is structured using the color filter 500 applying exemplary embodiments of the present invention, and is an exploded perspective view showing a schematic structure of a transmissive type of TFT (Thin Film Transistor) type liquid crystal device.

In this liquid crystal device 550, the color filter 500 is arranged on the upper side in the figure (observer's side).

This liquid crystal device 550 is schematically composed of the color filter 500, an counter substrate 551 arranged so as to be opposed to this, a liquid crystal layer held between these, which is not shown in the figure, a polarizing plate 555 arranged on the upper surface side (observer's side) of the color filter 500, and a polarizing plate (not shown) arranged on the lower surface side of the counter substrate 551.

On a surface of the protective film 509 of the color filter 500 (a surface on the counter substrate 551 side), an electrode 556 to drive the liquid crystal is formed. This electrode 556 is made of a transparent conductive material such as ITO, and is an entire surface electrode covering the whole region where pixel electrodes 560 described later are formed. Furthermore, an orientation film 557 is provided in a state of covering a surface of this electrode 556 on the opposite side of the pixel electrodes 560.

On a surface of the counter substrate 551 opposed to the color filter 500, an insulating layer 558 is formed, and on this insulating layer 558, scanning lines 561 and signal lines 562 are formed in a state of being perpendicular to each other. In the regions surrounded by these scanning lines 561 and the signal lines 562, the pixel electrodes 560 are formed. Although in the actual liquid crystal device, on the pixel electrodes 560, an orientation film is provided, it is omitted in the figure.

Furthermore, in parts surrounded by notched parts of the pixel electrodes 560, the scanning lines 561, and the signal lines 562, thin film transistors 563 including source electrodes, drain electrodes, semiconductors and gate electrodes, are incorporated. By applying signal to the scanning lines 561 and the signal line 562*s*, the thin film transistor 563*s* are turned on and off to perform the current control for the pixel electrodes 560.

The liquid crystal devices 520, 530, and 550 of the respective examples described above have a transmissive type structure, however, they can be also reflection type liquid crystal devices or semi-transmissive reflection type liquid crystal devices by providing a reflection layer or a semi-transmissive reflection layer, respectively.

Figure 11:
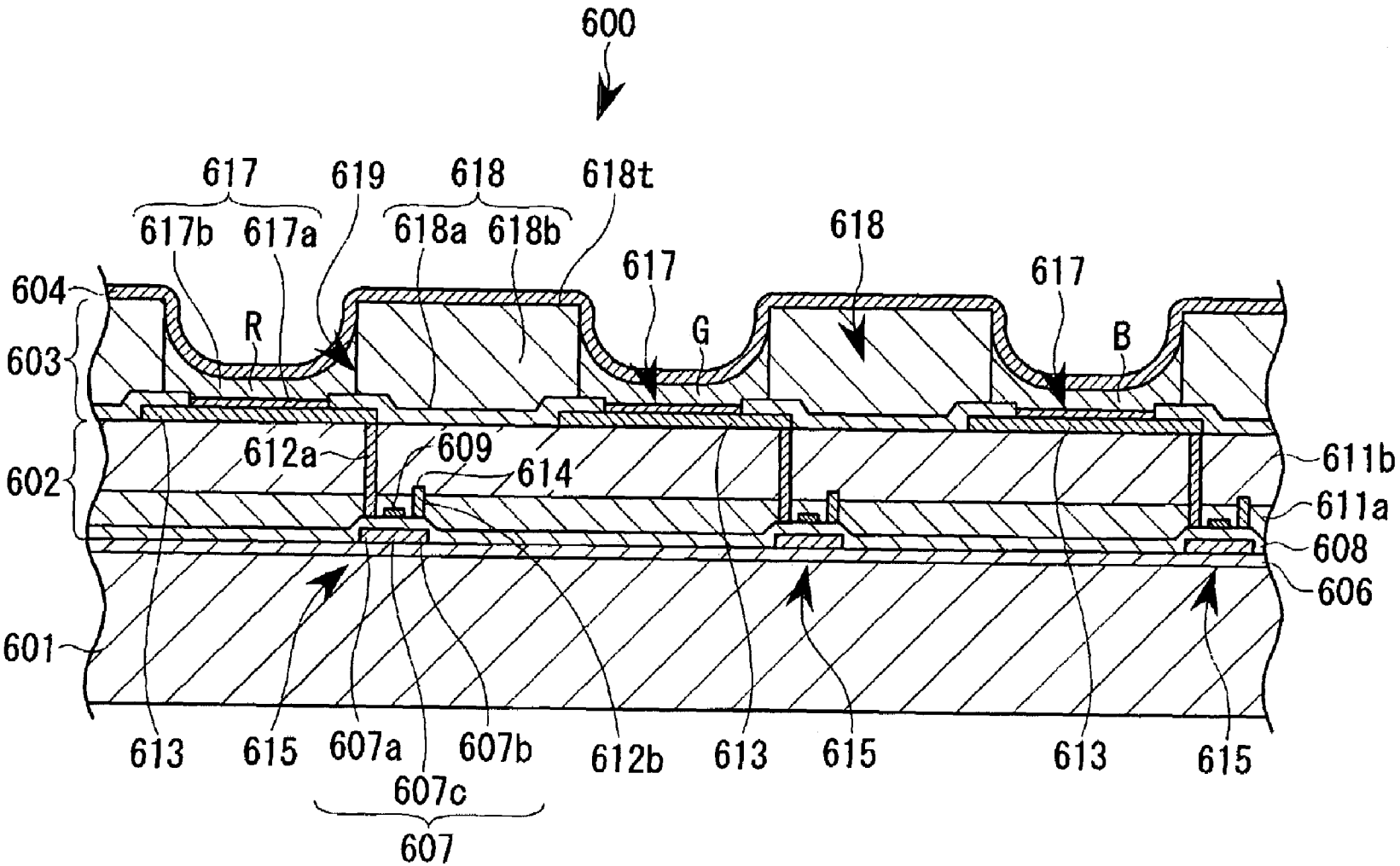
FIG. 11 is a schematic substantial part cross-sectional view showing a display device which is an organic EL device.

Next, FIG. 11, is a schematic substantial part cross-sectional view of a display region of an organic EL device (hereinafter, referred to only as a display device 600).

This display device 600 is schematically structured so that on a substrate (W) 601, a circuit element part 602, a light emitting element part 603, and a negative electrode 604 are deposited.

In this display device 600, light emitted from the light emitting element part 603 to the substrate 601 side passes through the circuit element part 602 and the substrate 601 to be emitted to the side of an observer, and light emitted from the light emitting element part 603 to the opposite side of the substrate 601 is reflected by the negative electrode 604, and then passes through the circuit element part 602 and the substrate 601 to be emitted to the side of the observer.

Between the circuit element part 602 and the substrate 601, a base protective film 606 made of a silicon oxide film is formed, and on this base protective film 606 (on the light emitting element part 603 side), island-shaped semiconductor films 607 made of polycrystalline silicon are formed. In lateral regions of these semiconductor films 607, source regions 607*a* and drain regions 607*b* are formed by high concentrations of positive ion implantation, respectively. Central parts where no positive ion is implanted are channel regions 607*c*.

Furthermore, in the circuit element part 602, a transparent gate insulating film 608 covering the base protective film 606 and the semiconductor films 607 is formed. At positions corresponding to the channel regions 607*c* of the semiconductor films 607 on this gate insulating film 608, gate electrodes 609 made of Al, Mo, Ta, Ti, W or the like, for example, are formed. On these gate electrodes 609 and the gate insulating film 608, a transparent first interlayer insulating film 611*a* and a transparent second interlayer insulating film 611*b* are formed. There are formed contact holes 612*a* and 612*b* penetrating the first and second interlayer insulating films 611*a* and 611*b* and communicating to the source regions 607*a* and the drain regions 607*b* of the semiconductor films 607, respectively.

In addition, on the second interlayer insulating film 611*b*, transparent pixel electrodes 613 made of ITO or the like are patterned in a predetermined shape, and these pixel electrodes 613 are coupled to the source regions 607*a* through the contact holes 612*a*.

Furthermore, on the first interlayer insulating film 611*a*, electric source lines 614 are arranged, and theses electric source lines 614 are coupled to the drain regions 607*b* through the contact holes 612*b*.

In this manner, in the circuit element part 602, thin film transistors 615 for driving coupled to the respective pixel electrodes 613 are formed, respectively.

The above-mentioned light emitting element part 603 is schematically composed of functional layers 617 deposited on the plurality of pixel electrodes 613, respectively, and bank parts 618 demarcating the respective functional layers 617, each of which is provided between the pixel electrodes 613 and the functional layers 617.

The light emitting elements are composed of these pixel electrodes 613, the functional layers 617, and negative electrode 604 arranged on the functional layers 617. The pixel electrodes 613 are patterned in a substantial rectangular shape in plane view to be formed, and between each of the pixel electrodes 613, the bank parts 618 are formed.

The bank parts 618 are composed of inorganic bank layers 618*a* (first bank layer) formed of an inorganic material such as SiO, $SiO_2$ and $TiO_2$, for example, and organic bank layers 618*b* (second bank layer) with a trapezoidal cross section, which is deposited on the inorganic bank layers 618*a* and is formed by a resist excellent in heat resistance and solvent resistance such as acrylic resin and polyimide resin. The bank parts 618 are formed in a state of partially riding on the peripheral parts of the pixel electrodes 613.

Between the respective bank parts 618, there are formed opening parts 619 gradually spreading and opening upward with respect to the pixel electrodes 613.

The above-mentioned functional layers 617 are composed of hole injection/transport layers 617*a* formed in deposited state on the pixel electrodes 613 in the opening parts 619 and light emitting layers 617*b* formed on this hole injection/transport layers 617*a*. Adjacently to these light emitting layers 617*b*, other functional layers having other functions may be further formed. For example, an electron transport layer can be formed.

The hole injection/transport layers 617*a* have a function of transporting the hole from the pixel electrodes 613 side and injecting it into the light emitting layers 617*b*. This hole injection/transport layers 617*a* are formed by discharging a first composition (functional liquid) containing a hole injection/transport layer forming material. As the hole injection/transport layer forming material, a publicly known material is used.

The light emitting layers 617*b* emit light of any one of red (R), green (G) and blue (B), and are formed by discharging a second composition (functional liquid) containing a light emitting layer forming material (light emitting material). As a solvent of the second composition (nonpolar solvent), a publicly known material which is insoluble with respect to the hole injection/transport layers 617*a* are preferably used, and by using such a nonpolar solvent for the second composition of the light emitting layers 617*b*, the light emitting layers 617*b* can be formed without redissolving the hole injection/transport layers 617*a*.

The light emitting layers 617*b* are structured such that the hole injected from the hole injection/transport layers 617*a* and an electron injected from the negative electrode 604 are rebounded in the light emitting layer to emit light.

The negative electrode 604 is formed in a state of covering the entire surface of the light emitting element part 603, and plays a role of passing a current through the functional layers 617 while making pairs with the pixel electrodes 613. On the upper part of the negative electrode 604, a seal member not shown in the figure is arranged.

Next, a manufacturing process of the above-mentioned display device 600 is described referring to FIGS. 12 to 20.

Figure 12:
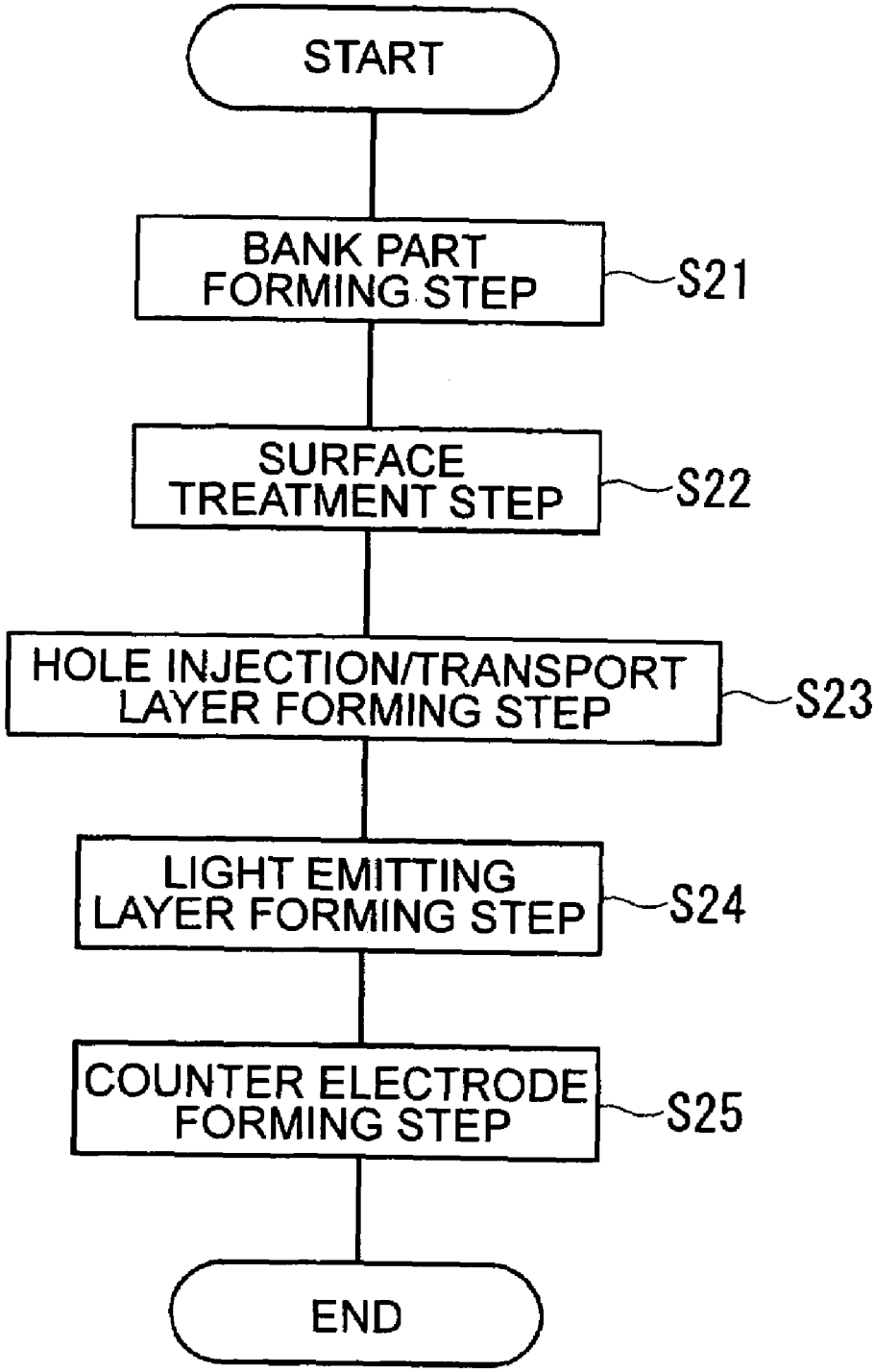
FIG. 12 is a flowchart explaining a manufacturing process of the display device which is an organic EL device.

This display device 600, as shown in FIG. 12, is manufactured via the bank part forming (S21), the surface treatment (S22), the hole injection/transport layer forming (S23), the light emitting layer forming (S24), and the counter electrode forming (S25). The manufacturing process is not limited to exemplified one, but as necessary, other steps may be removed or added.

Figure 13:
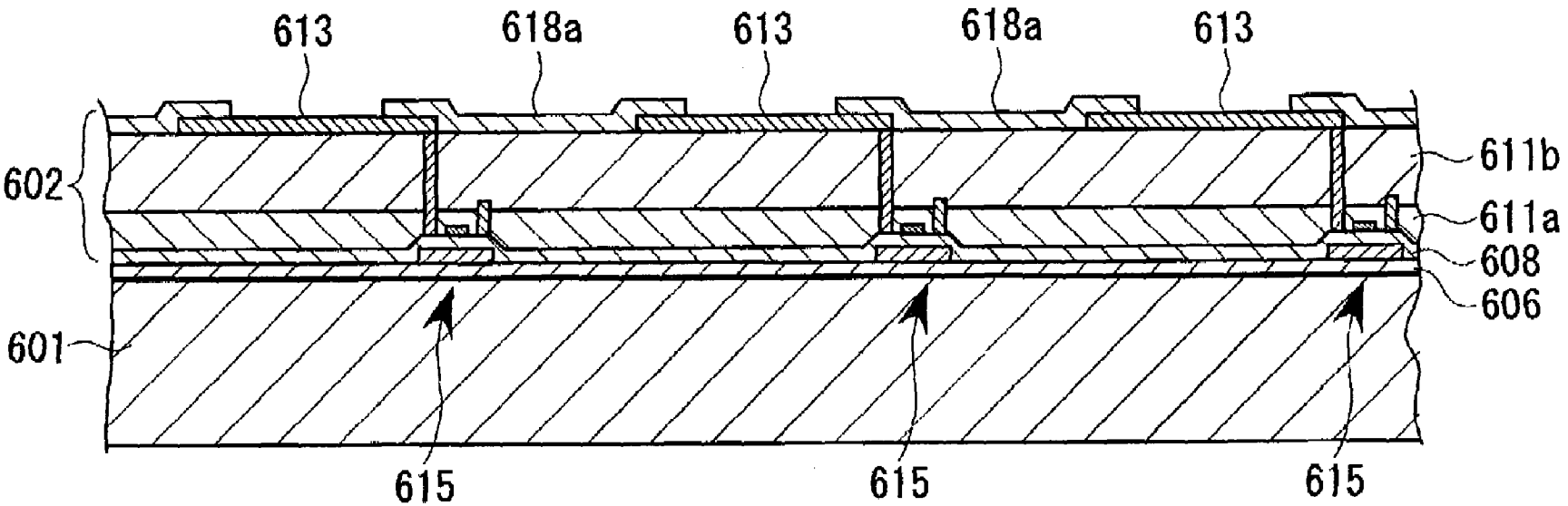
FIG. 13 is a process view explaining the formation of inorganic bank layers.

Firstly, in the bank part forming (S21), as shown in FIG. 13, on the second interlayer insulating film 611*b*, the inorganic bank layers 618*a* are formed. In regard to these inorganic bank layers 618*a*, after an inorganic film is formed at a forming position, the inorganic film is patterned by the photolithography technique or the like. At this time, it is formed so that the inorganic bank layers 618*a* partially overlap the peripheral parts of the pixel electrodes 613.

Figure 14:
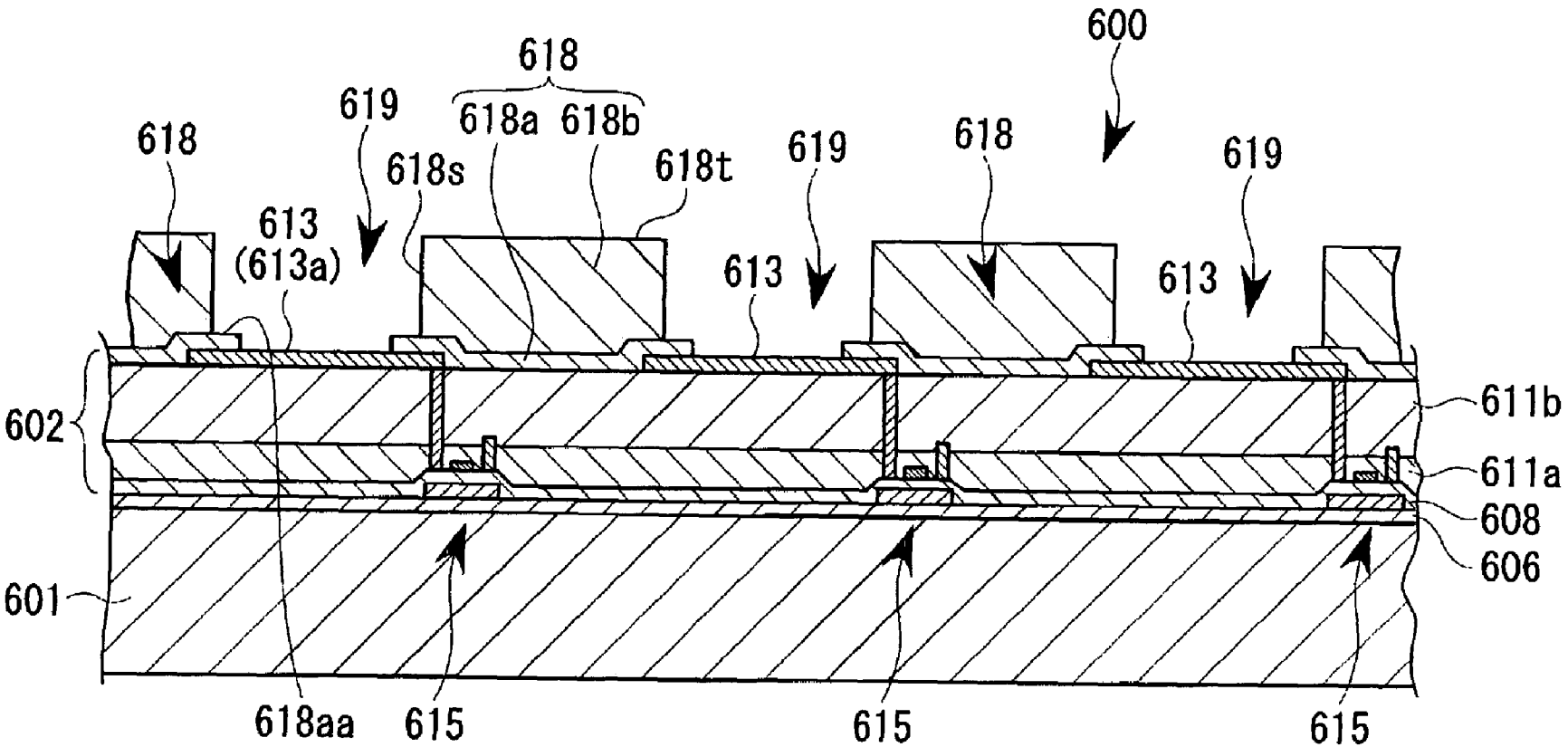
FIG. 14 is a schematic process view explaining the formation of organic bank layers.

After the inorganic bank layers 618*a* have been formed, as shown in FIG. 14, on the inorganic bank layers 618*a*, the organic bank layers 618*b* are formed. These organic bank layers 618*b* are also formed by patterning by photolithography technique or the like similarly to the inorganic bank layers 618*a*.

In this manner, the bank parts 618 are formed. Furthermore, with this, between the respective bank parts 618, the opening parts 619 opening upward with respect to the pixel electrodes 613, are formed. These opening parts 619 define the pixel regions.

In the surface treatment (S22), lyophilic treatment and liquid repellent treatment are performed. Regions subjected to the lyophilic treatment are first multi-layered parts 618*aa* of the inorganic bank layers 618*a* and electrode surfaces 613*a* of the pixel electrodes 613, and these regions are surface-treated to impart lyophilicity, for example, by plasma treatment using oxygen as a processing gas. This plasma treatment also functions as cleaning ITO which are the pixel electrodes 613, or the like.

Furthermore, the liquid repellent treatment is applied to wall surfaces 618*s* of the organic bank layers 618*b* and upper surfaces 618*t* of the organic bank layers 618*b*, and for example, the surfaces are subjected to fluoridation treatment (treated to be liquid repellent) by plasma treatment using methane tetrafluoride as a processing gas.

By performing the surface treatment, when forming the functional layers 617 using the droplet discharging heads 11, the functional droplet can be surely touched down on the pixel region, and the functional droplet touched down in the pixel region can be reduced or prevented from leaking out from the opening parts 619.

By undergoing the above-mentioned steps, a display device base body 600A can be obtained. This display device base body 600A is placed on the set table 66 of the droplet discharging device 1 as shown in FIG. 1, and the hole injection/transport layer forming (S23) and the light emitting layer forming (S24) are performed as described below.

Figure 15:
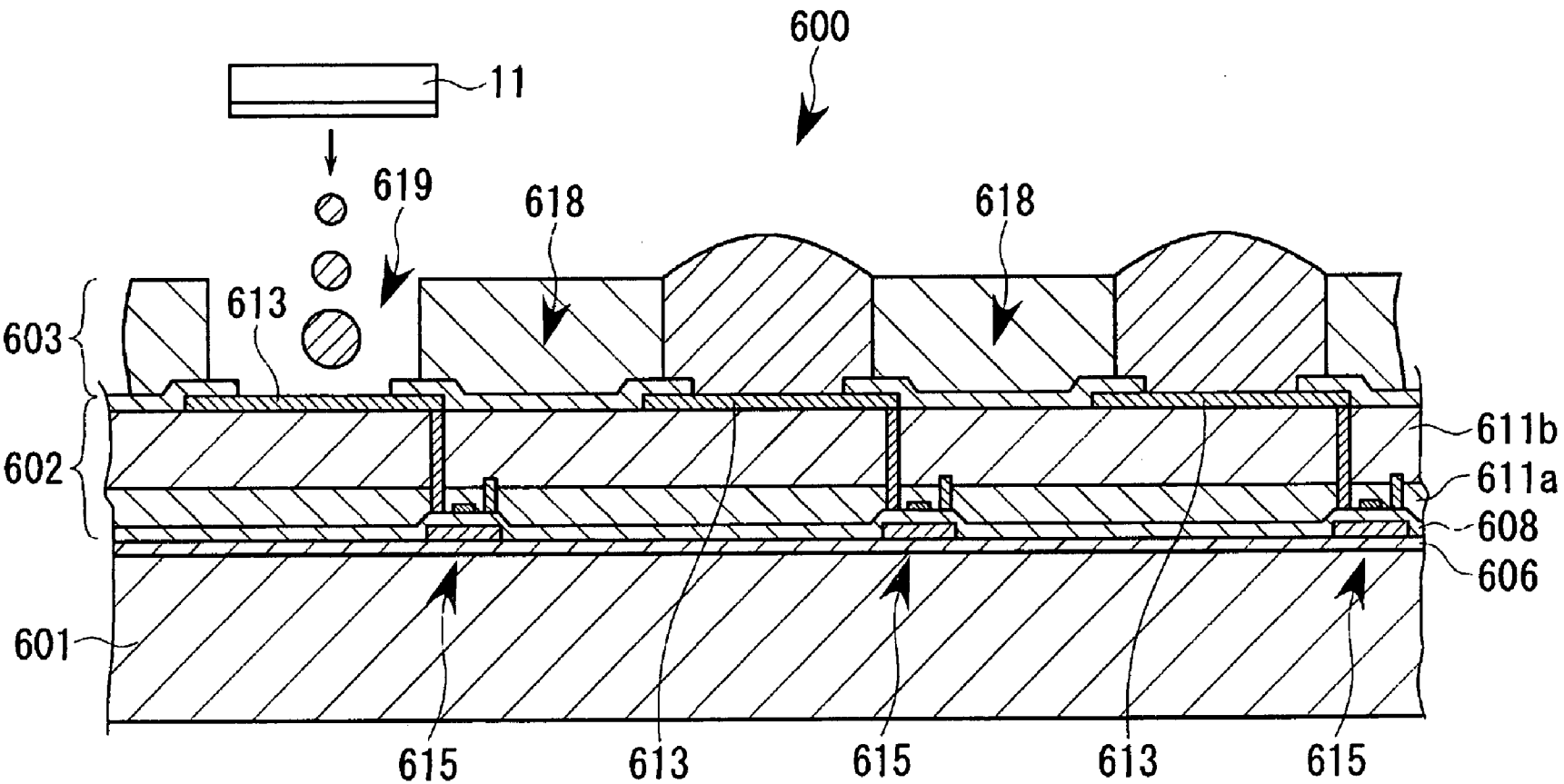
FIG. 15 is a schematic process view explaining a process to form hole injection/transport layers.
Figure 16:
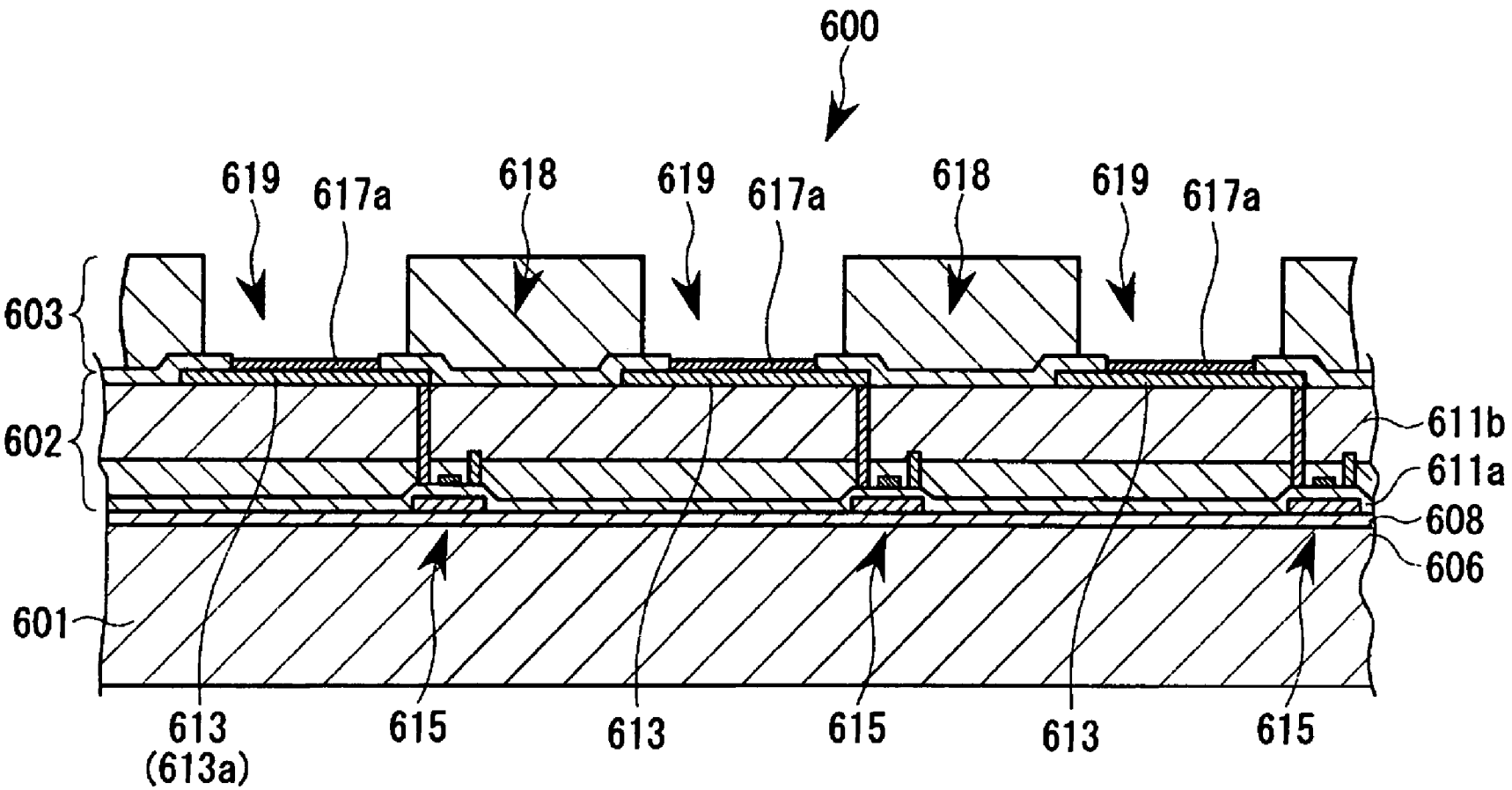
FIG. 16 is a schematic process view explaining a state that the hole injection/transport layers have been formed.

As shown in FIG. 15, in the hole injection/transport layer forming (S23), the first composition containing the hole injection/transport layer forming material from the droplet discharging heads 11 to each of the opening parts 619 which are the pixel regions. Thereafter, as shown in FIG. 16, drying treatment and heat treatment are performed to vaporize a polar solvent contained in the first composition and to form the hole injection/transport layers 617*a* on the pixel electrodes (electrode surfaces 613*a*) 613.

Next, the light emitting layer forming (S24) is described. In this light emitting layer forming as described above, in order to reduce or prevent the hole injection/transport layers 617*a* from being redissolved, an insoluble nonpolar solvent with respect to the hole injection/transport layers 617*a* are used as a solvent of the second composition used for forming the light emitting layer.

On the other hand, the hole injection/transport layers 617*a* have a low affinity to the nonpolar solvent and thus, even if the second composition containing the nonpolar solvent is discharged on the hole injection/transport layers 617*a*, there is a possibility that the hole injection/transport layers 617*a* and the light emitting layers 617*b* cannot be brought into close contact with each other, or the light emitting layers 617*b* cannot be uniformly applied.

Therefore, in order to increase the affinity of the surface of the hole injection transport layers 617*a* with respect to the nonpolar solvent and the light emitting layer forming material, surface treatment (surface modification treatment) is preferably performed before forming the light emitting layer. This surface treatment is such that a surface modification material which is the same solvent as the nonpolar solvent of the second composition used for forming the light emitting layer or a solvent analogous to the same is applied to the hole injection/transport layers 617*a* and dried.

By applying such a treatment, the surface of the hole injection/transport layers 617*a* become affinitive to the nonpolar solvent, and thus in the subsequent step, the second composition containing the light emitting layer forming material can be uniformly applied to the hole injection/transport layers 617*a*.

Figure 17:
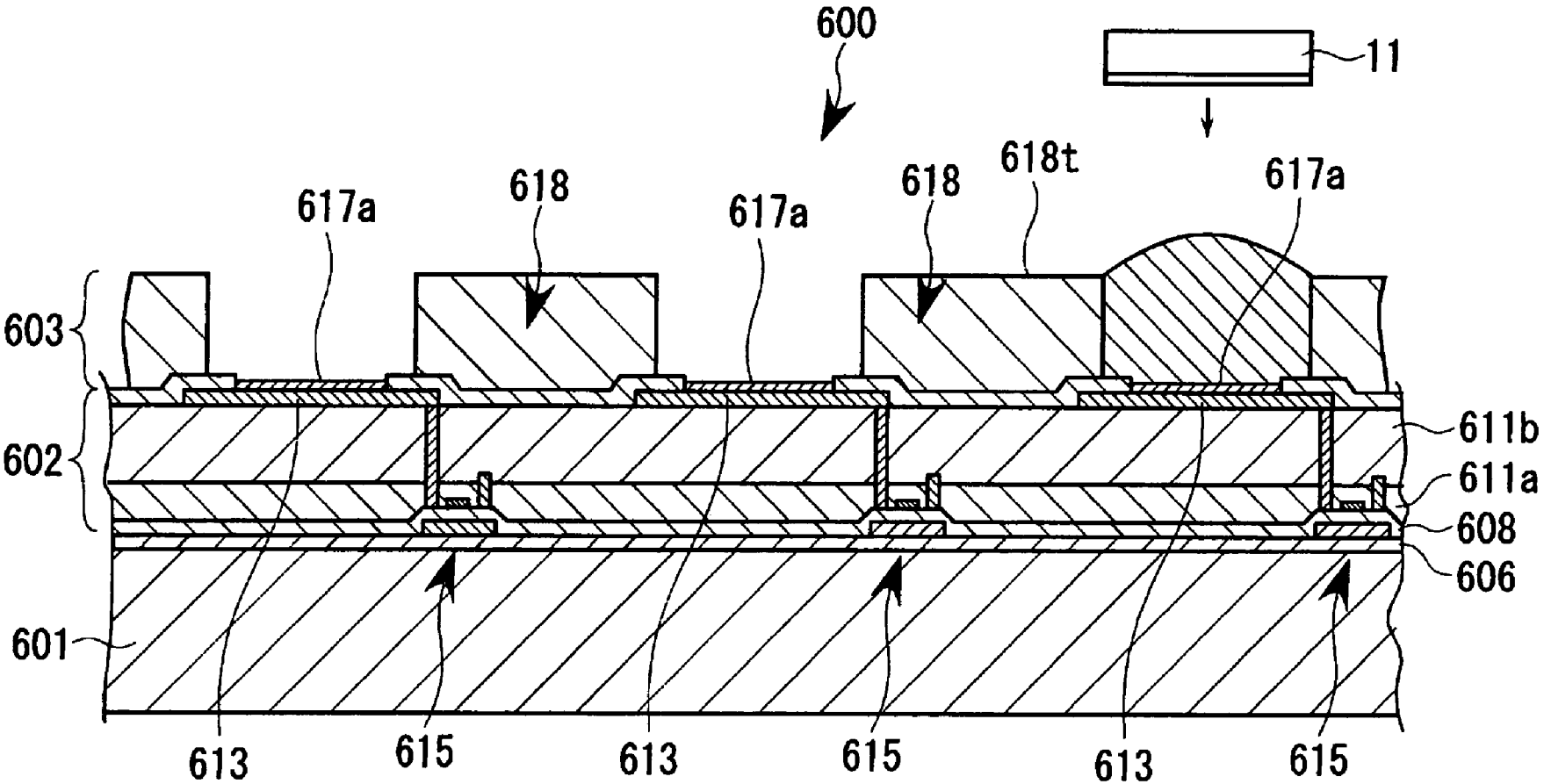
FIG. 17 is a schematic process view explaining a process to form a blue light emitting layer.

Next, as shown in FIG. 17, the second composition containing the light emitting layer forming material corresponding to any one of the colors (blue (B) in an example shown in FIG. 17) is implanted into the pixel region (opening parts 619) as the functional droplet in a predetermined amount. The second composition implanted into the pixel region spreads on the hole injection/transport layers 617*a* and charged in the opening parts 619. Even if the second composition deviates from the pixel region and touches down on the upper surfaces 618*t* of the bank parts 618, since this upper surfaces 618*t* are subjected to the liquid repellent treatment, the second composition easily rolls into the opening parts 619.

Figure 18:
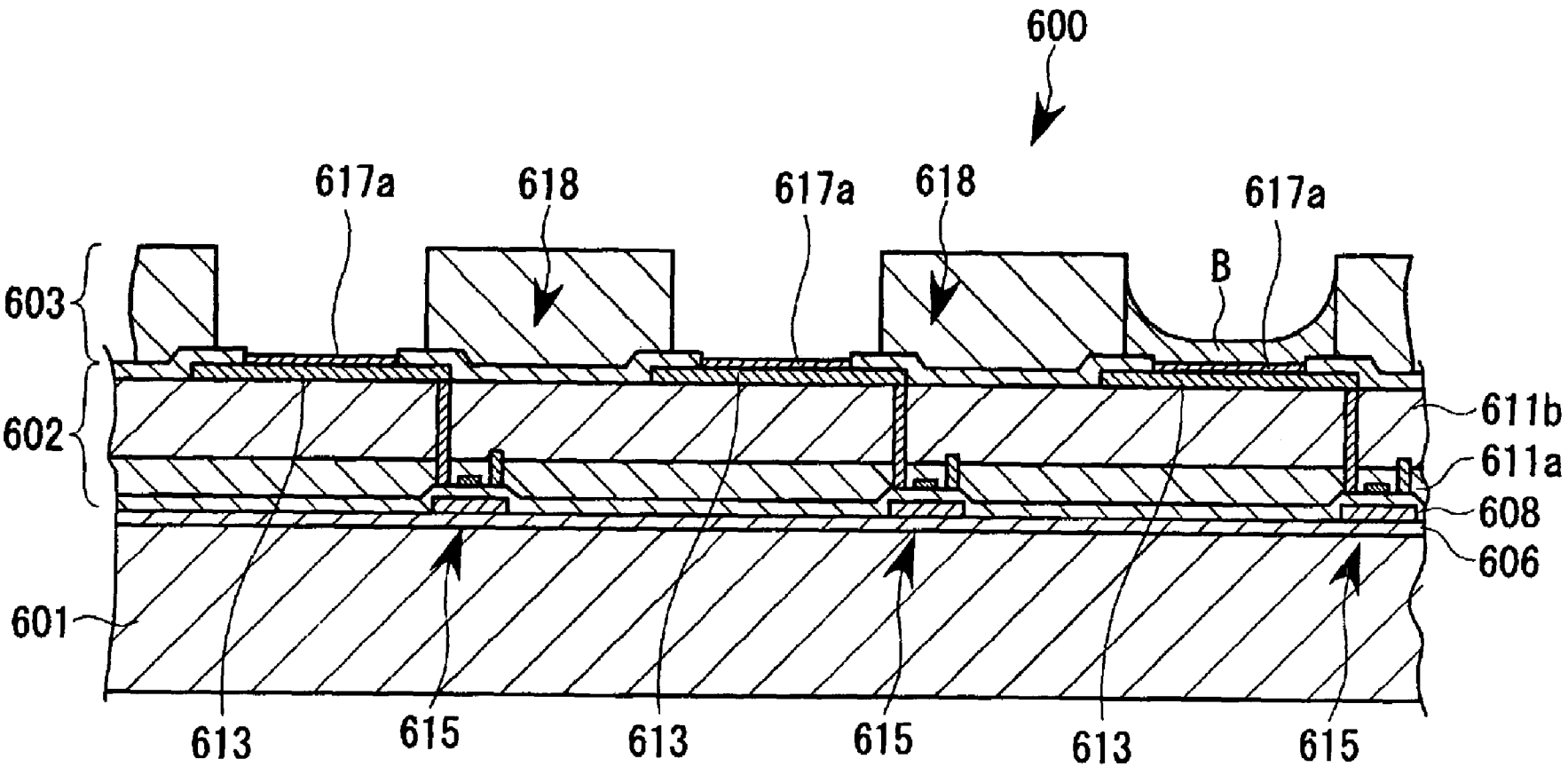
FIG. 18 is a schematic process view explaining a state that the blue light emitting layer has been formed.

Thereafter, by performing the drying or the like, the second composition after discharging is subjected to drying treatment to vaporize the nonpolar solvent contained in the second composition, and as shown in FIG. 18, the light emitting layers 617*b* are formed on the hole injection/transport layers 617*a*. In this figure, the light emitting layers 617*b* corresponding to blue (B) are formed.

Figure 19:
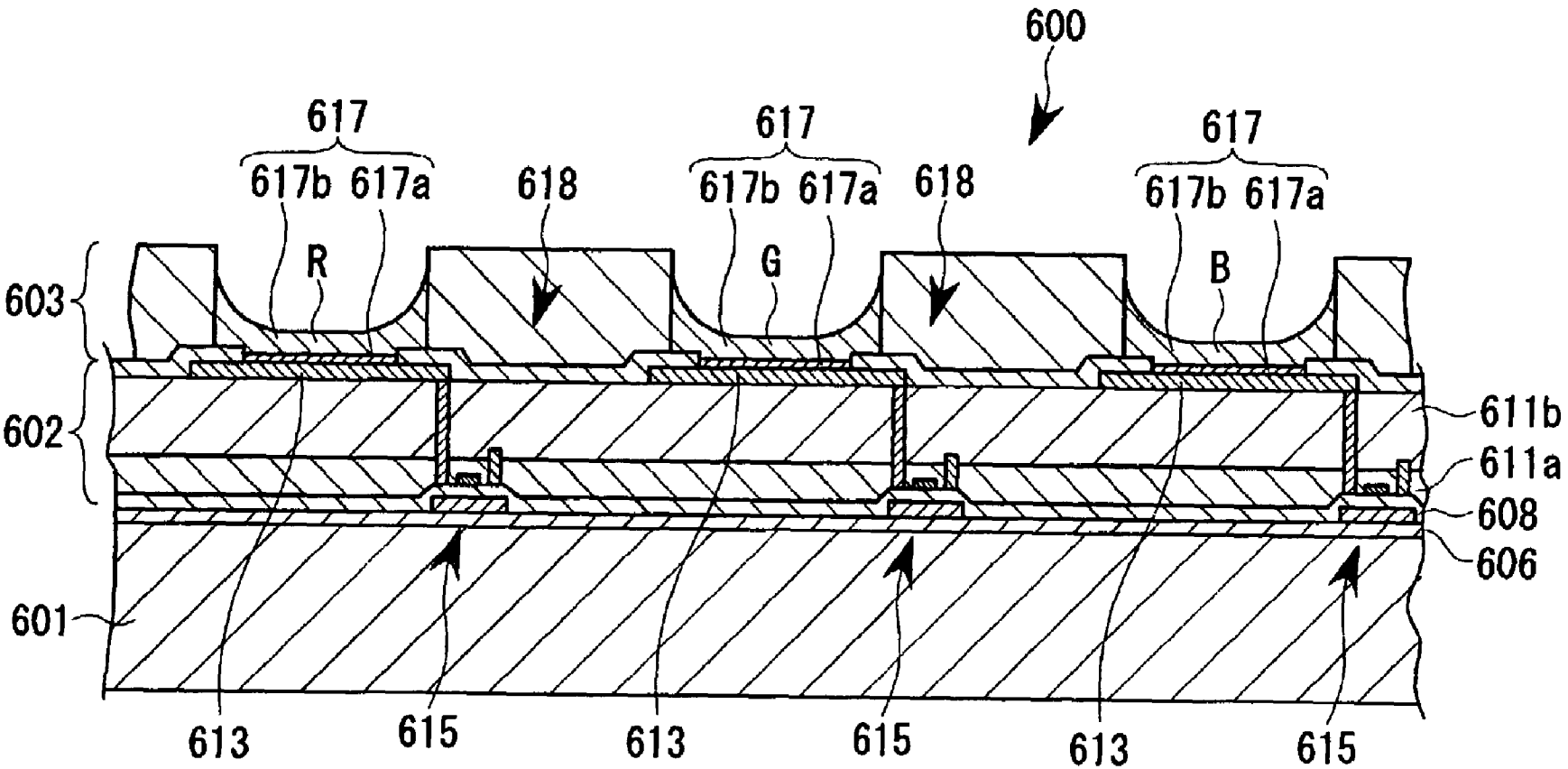
FIG. 19 is a schematic process view explaining a state that the light emitting layers of respective colors have been formed.

Similarly, using the droplet discharging heads 11, as shown in FIG. 19, the similar step to that of the above-mentioned light emitting layers 617*b* corresponding to blue (B), are sequentially performed to form the light emitting layers 617*b* corresponding to the other colors (red (R) and green (G)). The forming order of the light emitting layers 617*b* is not limited to the exemplified order, but the light emitting layers 617*b* may be formed in any order. For example, the forming order can be determined according to the light emitting layer forming materials. Furthermore, as an arrangement pattern of three colors of R, G and B, stripe arrangement, mosaic arrangement and delta arrangement or the like is exemplified.

As described above, the functional layers 617, that is, the hole injection/transport layers 617*a* and the light emitting layers 617*b* are formed on the pixel electrodes 613. Then, the process shifts to the counter electrode forming (S25).

Figure 20:
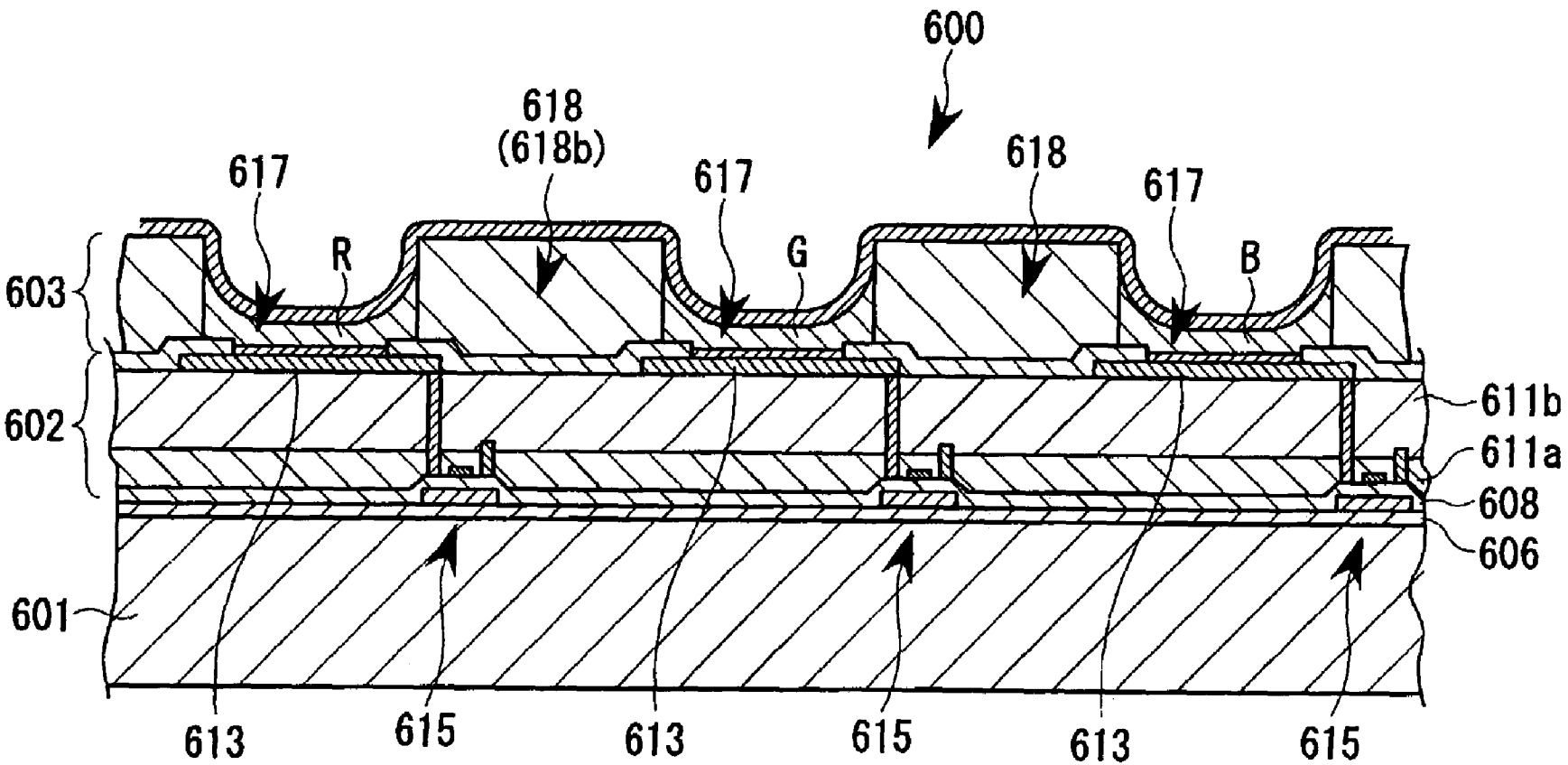
FIG. 20 is a schematic process view explaining the formation of negative electrodes.

In the counter electrode forming (S25), as shown in FIG. 20, on the entire surface of the light emitting layers 617*b* and the organic bank layers 618*b*, the negative electrode 604 (counter electrode) is formed, for example, by a vapor deposition method, a sputtering method, a CVD method or the like. In the present exemplary embodiment, this negative electrode 604 is composed by depositing a calcium layer and an aluminum layer, for example.

On the negative electrode 604, an Al film or an Ag film as an electrode, and a protective layer of $SiO_2$, SiN or the like for inhibiting oxidation are provided as necessary.

In this manner, the negative electrode 604 is formed, and then seal treatment sealing an upper part of the negative electrode 604 by a seal member, wiring process or other processes are performed to obtain the display device 600.

Figure 21:
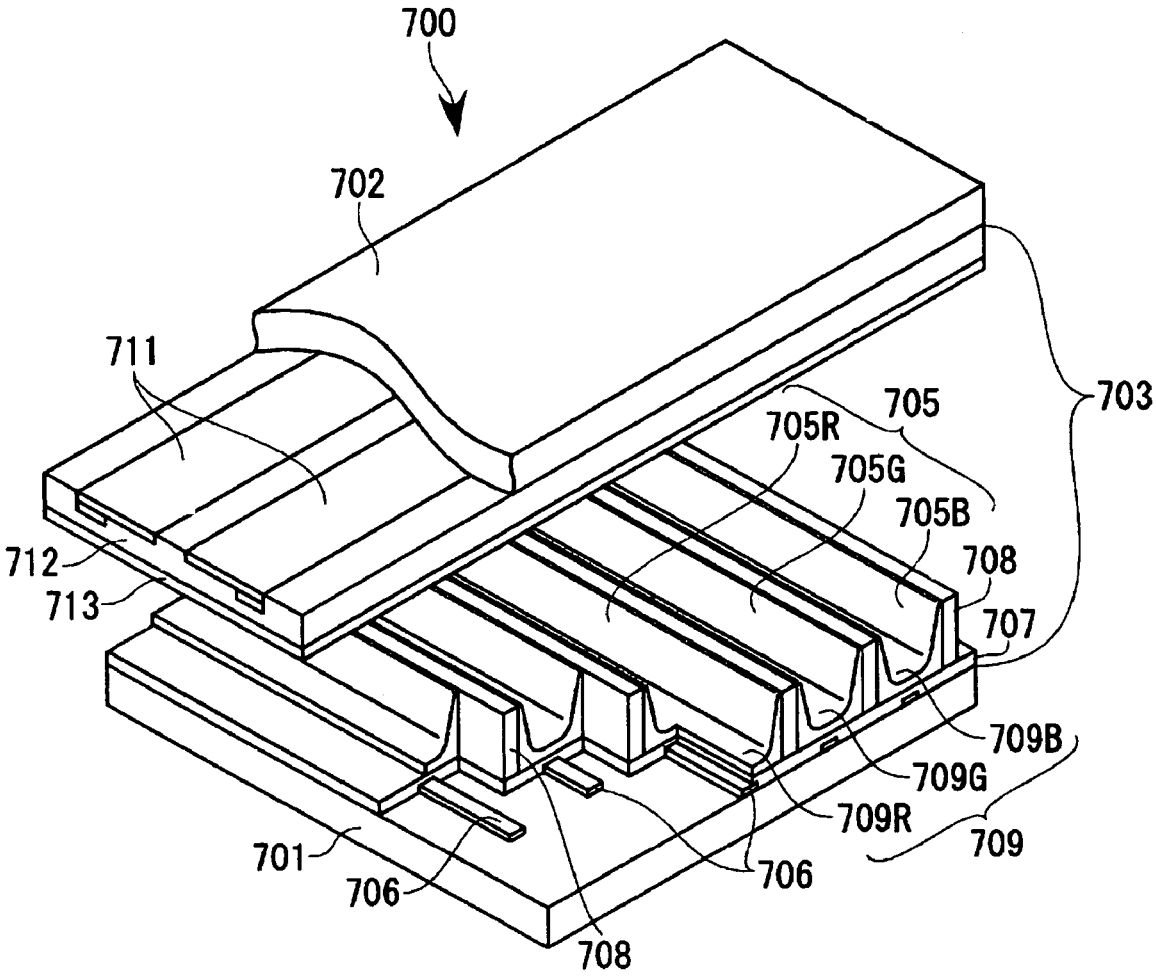
FIG. 21 is a schematic substantial part exploded perspective view of a display device which is a plasma type display device (PDP device)

Next, FIG. 21 is a schematic substantial part exploded perspective view of a plasma type display device (PDP device: hereinafter referred to only as an display device 700). In this figure, the display device 700 is shown in a state that a part thereof is notched.

This display device 700 schematically includes a first substrate 701 and a second substrate 702 which are arranged opposed to each other, and an electric discharge display part 703 formed between the substrates. The electric discharge display part 703 is composed of a plurality of electric discharge chambers 705. In these plurality of electric discharge chambers 705, three electric discharge chambers 705 of a red electric discharge chamber 705R, a green electric discharge chamber 705G, a blue electric discharge chamber 705B are arranged to make a set to compose one pixel.

On an upper surface of the first substrate 701, address electrodes 706 are formed in stripes at predetermined intervals, and a dielectric layer 707 is formed so as to cover the upper surfaces of the address electrodes 706 and the first substrate 701. On the dielectric layer 707, partition walls 708 are located between the respective address electrodes 706, and formed upright along the respective address electrodes 706. These partition walls 708 include ones extending on both sides in a width direction of the address electrodes 706 as shown in the figure, and ones extended in a direction perpendicular to the address electrodes 706, which are not shown in the figure.

The regions demarcated by these partition walls 708 are the electric discharge chambers 705.

Fluorescent substances 709 are arranged inside of the electric discharge chambers 705. The fluorescent substances 709 emits light of any color of red (R), green (G) and blue (B), and at a bottom part of a red electric discharge chamber 705R, a red fluorescent substance 709R is arranged, at a bottom part of a green electric discharge chamber 705G, a green fluorescent substance 709G is arranged, and at a bottom part of a blue electric discharge chamber 705B, a blue fluorescent substance 709B is arranged, respectively.

On a lower surface of the second substrate 702 in the figure, a plurality of display electrodes 711 are formed in a direction perpendicular to the above-mentioned address electrodes 706 in stripes at predetermined intervals. In addition, a dielectric layer 712 and a protective layer 713 made of MgO or the like are formed so as to cover the display electrodes 711.

The first substrate 701 and the second substrate 702 are stuck opposingly in a state that the address electrodes 706 and the display electrodes 711 are perpendicular to each other. The above described address electrodes 706 and the display electrodes 711 are coupled to an AC electric source not shown in the figure.

By energizing the respective electrodes 706 and 711, the fluorescent substances 709 are excited and emit light in the electric discharge display part 703, thereby enabling color display.

In the present exemplary embodiment, the address electrodes 706, the display electrodes 711, and the fluorescent substances 709 described above, can be formed using the droplet discharging device 1 shown in FIG. 1. Hereinafter, a forming process of the address electrodes 706 in the first substrate 701 is illustrated.

In this case, the following process is performed in a state that the first substrate 701 is placed on the set table 66 of the droplet discharging device 1.

Firstly, by a droplet discharging head 11, a liquid material (functional liquid) containing a conductive film wiring forming material is touched down in address electrode forming regions as the functional droplet. This liquid material is obtained by dispersing conductive fine particles such as metal in a dispersion medium as the conductive film wiring forming material. As these conductive fine particles, metal fine particles containing gold, silver, copper, palladium, nickel or the like, a conductive polymer or the like is used.

After the supply of the liquid material is completed with respect to all the address electrode forming regions to be supplied, the liquid material after discharge is subjected to drying treatment to vaporize the dispersion medium contained in the liquid material, thereby forming the address electrodes 706.

By the way, although in the foregoing, the formation of the address electrodes 706 is illustrated, the display electrodes 711 and the fluorescent substances 709 described above, can also be formed via each of the above-mentioned steps.

In the case of the formation of the display electrodes 711, as in the address electrodes 706, a liquid material (functional liquid) containing a conductive film wiring forming material is touched down in the display electrode forming regions as a functional droplet.

Furthermore, in the case of the formation of the fluorescent substances 709, a liquid material (functional liquid) containing a fluorescent material corresponding to each of the colors (R, G and B) is discharged as a droplet from the droplet discharging heads 11 to touch down in the electric discharge chambers 705 of the corresponding color.

Figure 22:
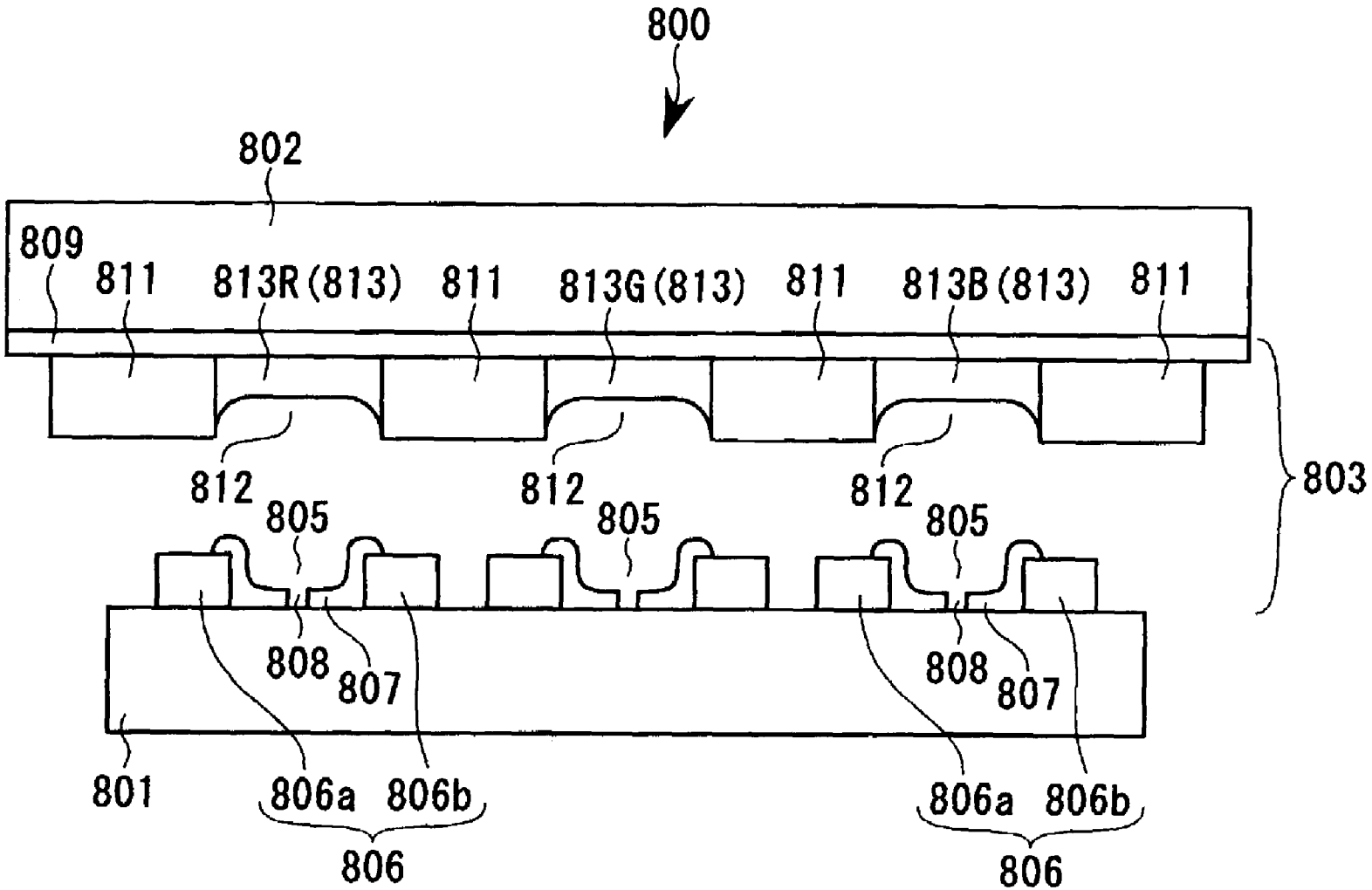
FIG. 22 is a schematic substantial part cross-sectional view of a display device which is an electron emission device (FED device)

Next, FIG. 22 is a schematic substantial part cross-sectional view of an electron emission device (it is also referred to as an FED device or an SED device: hereinafter referred to only as a display device 800). In this figure, a part of the display device 800 is shown as a cross section.

This display device 800 schematically includes a first substrate 801, a second substrate 802 which are arranged opposed to each other, and a field emission display part 803 formed between these substrates. The field emission display part 803 includes a plurality of electron emission parts 805 arranged in matrix.

On an upper surface of the first substrate 801, first element electrodes 806*a* and second element electrodes 806*b* including cathode electrodes 806 are formed so as to be perpendicular to each other. Furthermore, in parts demarcated by the first element electrodes 806*a* and the second element electrodes 806*b*, there are formed conductive films 807 each having gaps 808 formed. In other words, a plurality of electron emission parts 805 are composed by the first element electrodes 806*a*, the second element electrodes 806*b* and the conductive films 807. The conductive films 807 are composed of palladium oxide (PdO) or the like, and the gaps 808 are formed by foaming or the like after forming the conductive films 807.

On a lower surface of the second substrate 802, an anode electrode 809 confronting the cathode electrodes 806 is formed. On a lower surface of the anode electrode 809, bank parts 811 in a lattice shape are formed. In respective downward opening parts 812 surrounded by these bank parts 811, fluorescent substances 813 are arranged so as to correspond to the electron emission parts 805. Each of the fluorescent substances 813 emits fluorescence of any one of red (R), green (G) and blue (B), and in the respective opening parts 812, a red fluorescent substance 813R, a green fluorescent substance 813G and a blue fluorescent substance 813B are arranged in the above-mentioned predetermined pattern.

The first substrate 801 and the second substrate 802 structured in this manner are stuck to each other with a minute gap. In this display device 800, electrons flying out from the first element electrodes 806*a* or the second element electrodes 806*b* which are negative electrodes, through the conductive films (gaps 808) 807 are hit at the fluorescent substances 813 formed in the anode electrode 809 which is a positive electrode and the fluorescent substances 813 are excited and emit light, thereby enabling color display.

In this case, as in other exemplary embodiments, the first element electrodes 806*a*, the second element electrodes 806*b*, the conductive films 807 and the anode electrode 809 are formed using the droplet discharging device 1, and the fluorescent substances 813R, 813G, 813B of each color can be formed using the droplet discharging device 1.

Figure 23A:
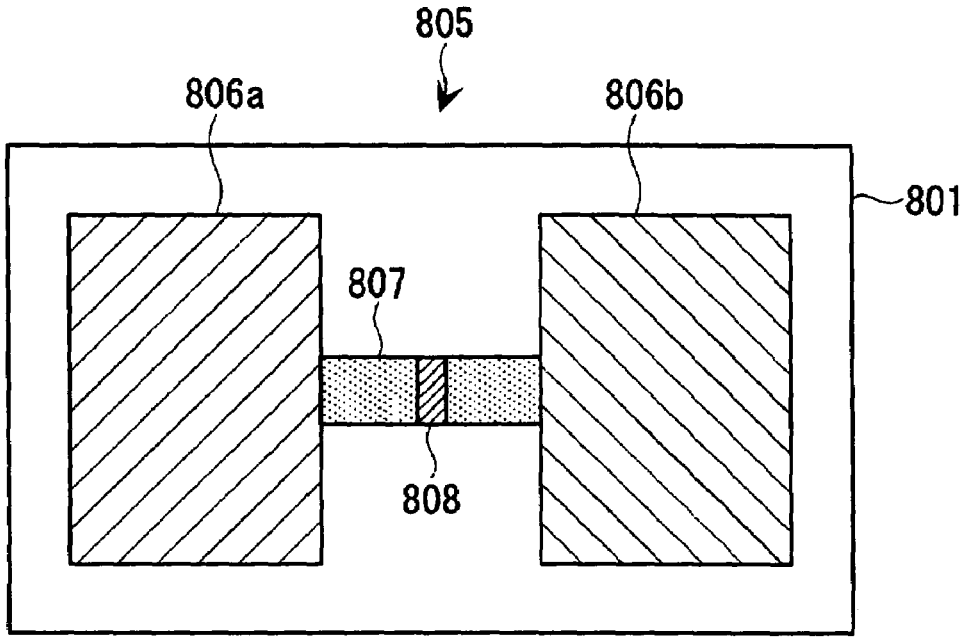
FIG. 23A is a schematic plane view around an electron emission part of a display device.
Figure 23B:
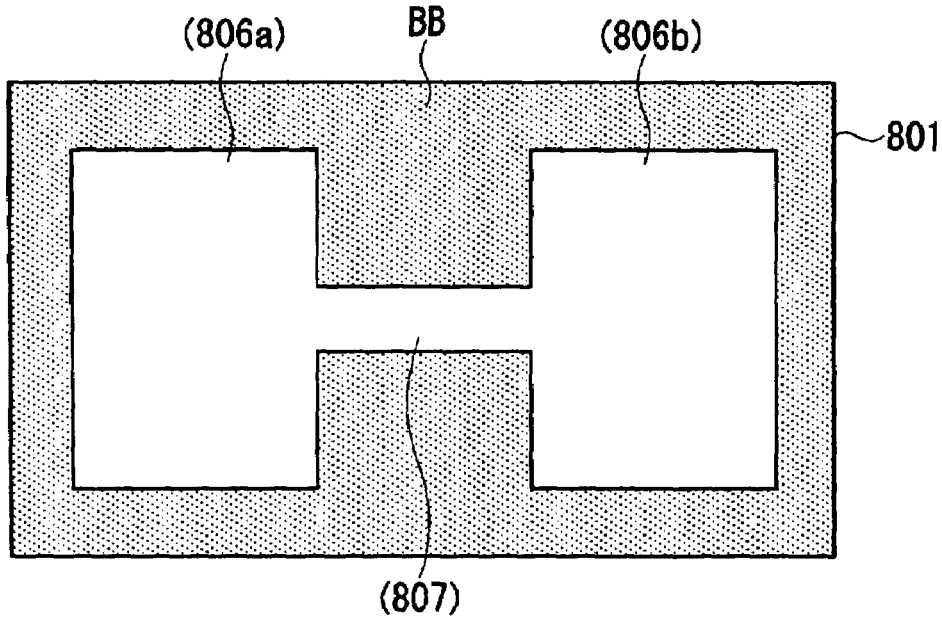
FIG. 23B is a schematic plane view showing a manufacturing method.

The first element electrodes 806*a*, the second element electrodes 806*b* and the conductive films 807 have such a plane shape as shown in FIG. 23A, and when forming these films, as shown in FIG. 23B, a bank part BB is formed (by a photolithography method) while leaving parts where the first element electrodes 806*a*, the second element electrodes 806*b* and the conductive films 807 are to be made in advance. Next, in groove parts constructed by the bank parts BB, the first element electrodes 806*a* and the second element electrodes 806*b* are formed (by an ink jet method by the droplet discharging device 1) and after drying the solvents to form the films, the conductive films 807 is formed (by an ink jet method by the droplet discharging device 1). In addition, after forming the film of the conductives film 807, the bank part BB is removed (by an ashing peeling treatment), and the process shifts to the above-mentioned foaming process. As in the above-mentioned organic EL device, the lyophilic treatment for the first substrate 801 and the second substrate 802 and the liquid repellent treatment for the bank parts 811 and BB, are preferably performed.

Furthermore, as other electro-optic devices, devices with metal wiring formation, with a lens formation, with a resist formation, and with a light diffusive element formed or the like can be considered. The above-mentioned droplet discharging device 1 is used for manufacturing of various electro-optic devices, thereby enabling the various electro-optic devices to efficiently be manufactured.

What is claimed is:

1. A volume measuring method, comprising:

acquiring a central point in horizontal plane view of a droplet dropped on a horizontal plane as origin coordinates, by an image recognizing device;

measuring outline coordinates of a droplet surface with respect to the origin coordinates at a plurality of positions while scanning a line segment connecting the acquired central point in horizontal plane view and one arbitrary point of an outer periphery of the droplet in a radial direction of the droplet, by an electromagnetic measuring device; and calculating a volume of the droplet based on the measurement result of the outline coordinates.

2. The volume measuring method according to claim 1, the acquiring including binarizing a recognition image image-recognized by the image recognizing device into a droplet image and a peripheral image thereof, thereby determining an outline of the droplet to acquire the central point in horizontal plane view as the origin coordinates; and informing as an error, in a case where the outline has a shape extremely misfitting a perfect circle.

3. The volume measuring method according to claim 1, the measuring including performing the scanning from the central point in horizontal plane view toward the outer periphery; and judging, using the electromagnet measuring device, that the one arbitrary point of the outer periphery is reached when a value of a height of the outline coordinates becomes zero.

4. The volume measuring method according to claim 1, the measuring including performing the scanning of the electromagnetic measuring device by intermittent movement corresponding to the measurement of the outline coordinates at the plurality of positions.

5. The volume measuring method according to claim 1, an interval of the intermittent movement in the measurement of the outline coordinates at the plurality of positions being gradually reduced from the central point in horizontal plane view toward the outer periphery.

6. The volume measuring method according to claim 1, the measuring including repeating several times the measurement by the electromagnetic measuring device, whose scanning direction varies; and the calculating including calculating the volume based on an average value of the plurality of outline coordinates obtained by repeating.

7. The volume measuring method according to claim 1, the electromagnetic measuring device being a laser type distance meter using laser light as measuring light.

8. A volume measuring device, comprising:

an image recognizing device to image a droplet dropped on a horizontal plane and to acquire a central point in horizontal plane view of the droplet as origin coordinates;

a coordinate measuring device to measure outline coordinates of a droplet surface with respect to the origin coordinates at a plurality of positions while scanning a line segment connecting the central point in horizontal plane view and one arbitrary point of an outer periphery of the droplet in a radial direction of the droplet; and a volume calculating device to calculate a volume of the droplet based on the measurement result of the outline coordinates.

9. The volume measuring device according to claim 8, the coordinate measuring device moving intermittently corresponding to the measurement of the outline coordinates at the plurality of positions, and the measurement being performed when the movement is ceased.

10. The volume measuring device according to claim 8, the coordinate measuring device repeating the measurement a plurality of times whose scanning direction varies, and the volume calculating device calculating the volume based on an average value of the plurality of outline coordinates obtained by repeating.

11. The volume measuring device according to claim 8, the coordinate measuring device being a laser type distance meter using laser light as measuring light.

12. A droplet discharging device for use with a functional droplet and a work, comprising:

a droplet discharging head including a plurality of nozzles, the droplet discharging head discharging the functional droplet toward the work from the plurality of nozzles to form a film formation part;

an X/Y moving mechanism relatively moving the work with respect to the droplet discharging head in an X axial direction and a Y axial direction;

the volume measuring device, according to claim 8 that calculates the volume of the functional droplet which is the droplet discharged from each of the nozzles; and a head control device correcting a driving waveform so as to uniformize the respective nozzles from the volume of the functional liquid of each of the plurality of nozzles calculated by the volume measuring device.

13. The droplet discharging device according to claim 12, the coordinate measuring device including a measuring device to measure outline coordinates of a droplet surface with respect to the origin coordinates at a plurality of positions in regard to the line segment, and a scanning device to make the measuring device scan the line segment in the radial direction of the functional droplet along with the measuring, the droplet discharging head being mounted on the X/Y moving mechanism via a carriage, the X/Y moving mechanism also functioning as the scanning device, and the measuring device being attached to the carriage.

14. The droplet discharging device according to claim 13, the image recognizing device being attached to the carriage.

15. A manufacturing method of an electro-optic device, comprising:

using the droplet discharging device according to claim 12; and forming on the work, the film formation part made of the functional droplet.

16. Electronic equipment comprising:

an electro-optic device manufactured by the manufacturing method of an electro-optic device according to claim 15.

17. An electro-optic device, comprising:

a droplet discharging device according to claim 12, the film formation part made of the functional droplet being formed on the work.

* * * * *